US006634744B2

(12) United States Patent
Yamamoto et al.

(10) Patent No.: US 6,634,744 B2
(45) Date of Patent: Oct. 21, 2003

(54) INK-JET PRINTER

(75) Inventors: Nobuya Yamamoto, Tokyo (JP); Kenji Negishi, Tokyo (JP); Hiroya Kimoto, Tokyo (JP); Takayuki Katoh, Tokyo (JP); Hiroyuki Honda, Tokyo (JP)

(73) Assignee: Konica Corporation, Tokyo (JP)

( * ) Notice: Subject to any disclaimer, the term of this patent is extended or adjusted under 35 U.S.C. 154(b) by 76 days.

(21) Appl. No.: 10/099,538

(22) Filed: Mar. 14, 2002

(65) Prior Publication Data

US 2002/0154202 A1 Oct. 24, 2002

(30) Foreign Application Priority Data

Mar. 23, 2001 (JP) ..... 2001-085604

(51) Int. Cl.[7] ..... B41J 2/01
(52) U.S. Cl. ..... 347/104

(58) Field of Search ..... 347/104, 101, 347/1; 400/578; 226/10; 399/361; 346/134; 271/6, 4.06

(56) References Cited

U.S. PATENT DOCUMENTS 6,419,411 B1 * 7/2002 Tanno ..... 400/635

* cited by examiner

*Primary Examiner*—Raquel Yvette Gordon
(74) *Attorney, Agent, or Firm*—Squire, Sanders & Dempsey, L.L.P.

(57) ABSTRACT

An ink-jet printer comprises: a recording head to eject ink through a nozzle; a conveying element located so as to face the recording head and conveying a recording medium onto which an image is recorded employing the recording head; and a recording medium expansion and contraction-preventing means provided at a contacting portion where the conveying element contacts the recording medium.

72 Claims, 30 Drawing Sheets

UNIT AREA

NUMBER OF HAIR 19A (●AND ◌) = 61

NUMBER OF FINE LINE 3a = 25

(INCIDENTALLY, ◌ MEANS THAT THE HAIR IS NOT VISIBLE SINCE IT IS HIDDEN BY FIBER.)

INK-JET PRINTER

FIELD OF THE INVENTION

The present invention relates to an ink-jet printer and particularly to an ink-jet printer which is suitable for ink jet printing onto fabrics.

BACKGROUND OF THE INVENTION

In regard to recording systems, printers are generally divided into a thermal system, a wire-dot system, and an ink-jet system. Of these, in ink-jet systems (ink-jet printers) while a recording medium (for example, representatively a paper sheet) is conveyed employing a conveying roller and a pressure roller, images are formed on the recording medium by ejecting ink droplets from the recording head. Heretofore, ink-jet printers have been employed as printing devices for paper sheets, but have been employed for printing images onto fabrics other than paper.

Fabrics employed for printing are comprised of various materials including natural fibers such as silk, wool, and cotton and synthetic fibers such as polyester, acryl, and nylon. Features of the fabrics differ depending upon fiber thickness, different weaving, the presence of hair-shaped napping, fiber knitting, and the like. Accordingly, different handling is required compared to the case in which paper is printed.

For example, a fabric does not exhibit sufficient stiffness capable of realizing stable conveyance, compared to paper and film sheet. As a result, when the fabric is conveyed employing only the aforethe conveyance roller and pressure roller so that the fabric is conveyed to the position facing a recording head, problems occur in which wrinkles tend to form. Further, the fabric is subjected to greater elongation as well as greater shrinkage (specifically, woven fabrics such as a knitted fabric are so) than paper and film sheet. As a result, the dimensions tend to be distorted. Incidentally, such wrinkles and distortion tend to occur along with an increase in width of the fabric.

When the wrinkles and distortion are formed, images formed on the fabric results in undesired deformation. For example, the amount of ink, which is to be uniform all over a fabric, may vary locally, and ink may not be ejected onto the target position. Due to such problems, images result in undesired deformation. As a result, generally, it is difficult to maintain high level quality images formed on a fabric.

SUMMARY OF THE INVENTION

From the viewpoint of the foregoing, the present invention was achieved. An object of the present invention is to provide an ink-jet printer capable of forming a high quality image by decreasing elongation and shrinkage of the recording medium as well as by retarding deformation of the recording medium at at least the position facing a recording head during the formation of images.

The aforethe object was achieved employing the structures described below.

Structure 1

An ink-jet printer which is provided with a recording head ejecting ink through nozzles, as well as with a conveying means which is arranged at the position facing the recording head and conveys a recording medium, and which is capable of forming an image on the recording medium by attaching ink ejected from the recording head while conveying the recording medium by the conveying means, the ink-jet printer is characterized in that a recording medium expansion and contraction-preventing means is provided at the contact position where the conveying means contacts the recording medium.

Structure 2

An ink-jet printer which is provided with a recording head which ejects ink through nozzles, as well as with a conveying means which is arranged at the position facing the recording head, and conveys a recording medium, and which is capable of forming an image on the recording medium by attaching ink ejected from the recording head while conveying the recording medium by the conveying means, the ink-jet printer is characterized in that the conveying means is an endless belt and the surface of the endless belt has raised portions.

Structure 3

In Structure 3, it is preferable that the raised portions are projections installed on the surface of the endless belt.

Structure 4

In Structure 3, it is preferable that the projections are installed on the entire surface of the endless belt.

Structure 5

In Structure 3, it is preferable that the projections are installed along the both edges of the surface of the endless belt in the perpendicular direction to the moving direction of the endless belt.

Structure 6

In Structure 3, it is preferable that the nozzle is formed in a nozzle plate and the recording head is arranged so as to be movable in the crossed direction of the conveying direction of the recording medium conveyed by the conveying means; and the projections are located to keep in noncontact with at least the nozzle surface of the nozzle plate where the nozzle is provided when the recording head moves in the crossed direction to the conveying direction of the recording medium and passes above the position facing the projections.

Structure 7

In Structure 3, it is preferable that the nozzle is formed in a nozzle plate; a guard member is provided so as to be near the nozzle and to nip the nozzle plate with respect to the moving direction of the recording head, and the guard member located so as to be projected than a nozzle surface, in which the nozzle is provided, of the nozzle plate; the projections are fixed onto the endless belt so as to enable to rise and fall; and when the recording head moves and then passes above the projections, the projections is brought down by the guard member so as to keep in noncontact with the nozzle surface.

Structure 8

In structure 3, it is preferable that the both edges of the surface of the endless belt are at least out of the region in which the image is recorded by the recording head; the nozzle is formed in the nozzle plate; the recording head is movable in the crossed direction to the conveying direction of the recording medium; and when passing above the projections, at least the nozzle surface of the nozzle plate, in which the nozzle is formed, is displaceable so that the nozzle surface keeps in noncontact the projections, when the recording head passes above the projections.

Structure 9

In Structure 3, it is preferable that the projections are needle-shaped members.

Structure 10

In Structure 9, it is preferable the needle-shaped members have bent form toward the downstream side in the conveying direction of the recording medium, or inclined form toward the downstream side in the conveying direction of the recording medium.

Structure 11

In Structure 3, it is preferable that the projections are installed with comprising a solid material.

Structure 12

In structure 11, it is preferable that the solid material is metallic particles, ceramic particles, or hard plastic particles.

Structure 13

In Structure 12, it is preferable that a medium into which the metallic particles, ceramic particles, or hard plastic particles are kneaded is coated onto the endless belt.

Structure 14

In Structure 12, it is preferable that a medium into which the metallic particles, ceramic particles, or hard plastic particles are kneaded is adhibited onto the endless belt.

Structure 15

In Structures 12 through 14, it is preferable that the metallic particles, ceramic particles, or hard plastic particles have a shape with a corner.

Structure 16

In Structure 3, it is preferable that the projections are hairs comprised of fibers.

Structure 17

In Structure 16, it is preferable that the hairs are implanted onto the surface of the endless belt.

Structure 18

In Structures 16 and 17, it is preferable that the recording medium is a fabric, and the number of the implanted hairs per unit area is more than the number of fine lines of the fabric per the unit area.

Structure 19

In Structures 16 through 18, it is preferable that the hairs are implanted so as to be erect.

Structure 20

In Structures 2 through 19, it is preferable that the endless belt is arranged so as to have a curvature radius of not less than 20 mm.

Structure 21

In Structures 2 through 20, it is preferable that the ink-jet printer comprises a re-adhesion preventing means to prevent re-adhesion of ink, which adheres onto the endless belt or the projections, onto the recording medium.

Structure 22

In Structure 21, it is preferable that the re-adhesion preventing means comprises a washing means to wash away the ink adhering onto the endless belt or the projections by spraying a washing liquid onto the endless belt.

Structure 23

In Structure 22, it is more preferable that the re-adhesion preventing means comprises a drying means to dry the endless belt after washing by the washing means.

Structure 24

In Structure 21, it is preferable that the re-adhesion preventing means comprises a drying means to dry ink adhering onto the endless belt or the projections.

Structure 25

In Structure 24, it is preferable that far-infrared rays are employed in the drying means.

Structure 26

In Structure 25, it is preferable that the far-infrared rays are generated by a far-infrared heater or a halogen heater.

Structure 27

In Structure 21, it is preferable that the re-adhesion preventing means comprises an absorbing means to absorb ink adhering onto the endless belt or the projections by contacting the endless belt.

Structure 28

In Structures 2 through 27, it is preferable that the ink-jet printer comprises a removing means to remove a part of the projection, which drop from the endless belt and adhere onto the recording medium.

Structure 29

In Structure 28, it is preferable that the removing means comprises an electrostatic adhesion means to adhere the part of the projection adhering to the recording medium by electrostatic adhesion force.

Structure 30

In Structure 28, it is preferable that the removing means has a cleaning roller, which is rotatably supported and located so as to contact the recording medium, to remove a part of the projections by glue or a gluing material provided on the surface of cleaning roller.

Structure 31

In Structure 28, it is preferable that the removing means has a cleaning roller, which is rotatably supported and located so as to contact the recording medium, to remove a part of the projections by a double-faced tape adhibited on the surface of cleaning roller.

Structure 32

In Structure 28, it is preferable that the removing means has a cleaning roller, which is rotatably supported and located so as to contact the recording medium, to remove a part of the projections by an adhesive rubber provided on the surface of cleaning roller.

Structure 33

In Structures 30 through 32, it is preferable that the removing means comprises a retrieving means to retrieve the part of the projections transferred on to the cleaning roller.

Structure 34

In Structures 2 through 33, it is preferable that the endless belt faces the recording head and provided to the position of the downstream with respect to the image forming region by the recording head.

Structure 35

In an ink-jet printer which is provided with a recording head ejecting ink through the nozzle, as well as with a conveying means which is located at the position facing the recording head and conveys a recording medium, and which is capable of forming an image on the recording medium by attaching ink ejected from the recording head while conveying the recording medium by the conveying means, the ink-jet printer is characterized in that the conveying means is a platen roller and the surface of the platen roller has raised portions.

Structure 36

In Structure 35, it is preferable that the raised portions are projections installed on the surface of the platen roller.

Structure 37

In Structure 36, it is preferable that the projections are installed on the entire surface of the platen roller.

Structure 38

In Structure 36, it is preferable that the projections are installed along the both edges of the surface of the platen roller.

Structure 39

In Structure 36, it is preferable that the nozzle is formed in the nozzle plate and the recording head is arranged so as to be movable in the crossed direction to the conveying direction of the recording medium; and the projections are located so as to keep in noncontact with at least the nozzle surface of the nozzle plate, where the nozzle is provided, of the recording head when the recording head moves in the crossed direction and passes above the projections.

Structure 40

In Structure 36, it is preferable that the nozzle is formed in a nozzle plate; a guard member is provided so as to be near the nozzle and to nip the nozzle plate with respect to the moving direction of the recording head, and the guard member located so as to be projected than a nozzle surface, in which the nozzle is provided, of the nozzle plate; the projections are fixed onto the platen roller so as to enable to rise and fall; and when the recording head moves and then passes above the projections, the projections is brought down by the guard member so as to keep in noncontact with the nozzle surface.

Structure 41

In structure 36, it is preferable that the both edges of the surface of the platen roller are at least out of a region in which the image is recorded by the recording head; the nozzle is formed in the nozzle plate; the recording head is movable in the crossed direction to a conveying direction of the recording medium; and when passing above the projections, at least the nozzle surface of the nozzle plate, in which the nozzle is formed, is displaceable so that the nozzle surface keeps in noncontact the projections, when the recording head passes above the projections.

In Structures 36 through 41, it is preferably that the projections are needle-shaped members.

Structure 43

In Structure 42, it is preferable the needle-shaped members have bent form toward the downstream side in the conveying direction of the recording medium, or inclined form toward the downstream side in the conveying direction of the recording medium.

Structure 44

In Structures 36 through 41, it is preferable that the projections are installed with comprising a solid material.

Structure 45

In structure 44, it is preferable that the solid material is metallic particles, ceramic particles, or hard plastic particles.

Structure 46

In Structure 45, it is preferable that a medium into which the metallic particles, ceramic particles, or hard plastic particles are kneaded is coated onto the platen roller.

Structure 47

In Structure 45, it is preferable that a medium into which the metallic particles, ceramic particles, or hard plastic particles are kneaded is adhibited onto the platen roller.

Structure 48

In Structures 45, it is preferable the metallic particles, ceramic particles, or hard plastic particles have a shape with a corner.

Structure 49

In Structures 36 through 41, it is preferable that the projections are hairs comprised of fibers.

Structure 50

In Structure 49, it is preferable that the hairs are implanted onto the surface of the platen roller.

Structure 51

In Structures 49 and 50, it is preferable that the recording medium is a fabric, and the number of the hairs per unit area, which are implanted, is more than the number of fine lines of the fabric.

Structure 52

In Structures 49 through 51, it is preferable that the hairs are implanted so as to be erect.

Structure 53

In Structures 35 through 52, it is preferable that the ink-jet printer comprises a re-adhesion preventing means to prevent re-adhesion of ink, which adheres onto the platen roller or the projections, onto the recording medium.

Structure 54

In Structure 53, it is preferable that the re-adhesion preventing means comprises a washing means to wash away the ink adhering onto the platen roller or the projections by spraying a washing liquid onto the platen roller.

Structure 55

In Structure 54, it is preferable that the re-adhesion preventing means comprises a drying means to dry the platen roller after washing by the washing means.

Structure 56

In Structure 53, it is preferable that the re-adhesion preventing means is provided with a drying means to dry ink adhering onto the platen roller or the projections.

Structure 57

In Structure 56, it is preferable that far-infrared rays are employed in the drying means.

Structure 58

In Structure 57, it is preferable that the far-infrared rays are generated by a far-infrared heater or a halogen heater.

Structure 59

In Structure 53, it is preferable that the re-adhesion preventing means comprises an absorbing member to absorb ink adhering onto the platen roller or the projections by contacting the platen roller.

Structure 60

In Structures 35 through 59, it is preferable that the ink-jet printer comprises a removing means to remove a part of the projection, which drop from the platen roller and adhered onto the recording medium.

Structure 61

In Structure 60, it is preferable that the removing means comprises an electrostatic adhesion means to adhere the part of the projection adhering to the recording medium by electrostatic adhesion force.

Structure 62

In Structure 60, it is preferable that the removing means has a cleaning roller, which is rotatably supported and located so as to contact the recording medium, to remove a part of the projections by glue or a gluing material provided on the surface of cleaning roller.

Structure 63

In Structure 60, it is preferable that the removing means has a cleaning roller, which is rotatably supported and located so as to contact the recording medium, to remove a part of the projections by a double-faced tape adhibited on the surface of cleaning roller.

Structure 64

In Structure 60, it is preferable that the removing means has a cleaning roller, which is rotatably supported and located so as to contact the recording medium, to remove a part of the projections by an adhesive rubber provided on the surface of cleaning roller.

Structure 65

In Structures 62 through 64, it is preferable that the removing means comprises a retrieving means to retrieve the part of the projections transferred on to the cleaning roller.

Structure 66

In an ink-jet printer which is provided with a recording head which ejects ink through a nozzle, as well as with a conveying means which is arranged at the position facing the recording head and conveys a recording medium, and which is capable of forming an image on the recording medium by attaching ink ejected from the recording head while conveying the recording medium by the conveying means, the ink-jet printer is characterized in that the conveying means is an endless belt and the surface of the endless belt has an adhesive rubber.

Structure 67

In an ink-jet printer which is provided with a recording head which ejects ink through a nozzle, as well as with a conveying means which is arranged at the position facing the recording head and conveys a recording medium, and which is capable of forming an image on the recording medium by attaching ink ejected from the recording head while conveying the recording medium by the conveying means, the ink-jet printer is characterized in that the conveying means is a platen roller and the surface of the platen roller has an adhesive rubber.

DETAILED DESCRIPTION OF THE PREFERRED EMBODIMENTS (First Embodiment)

Figure 1:
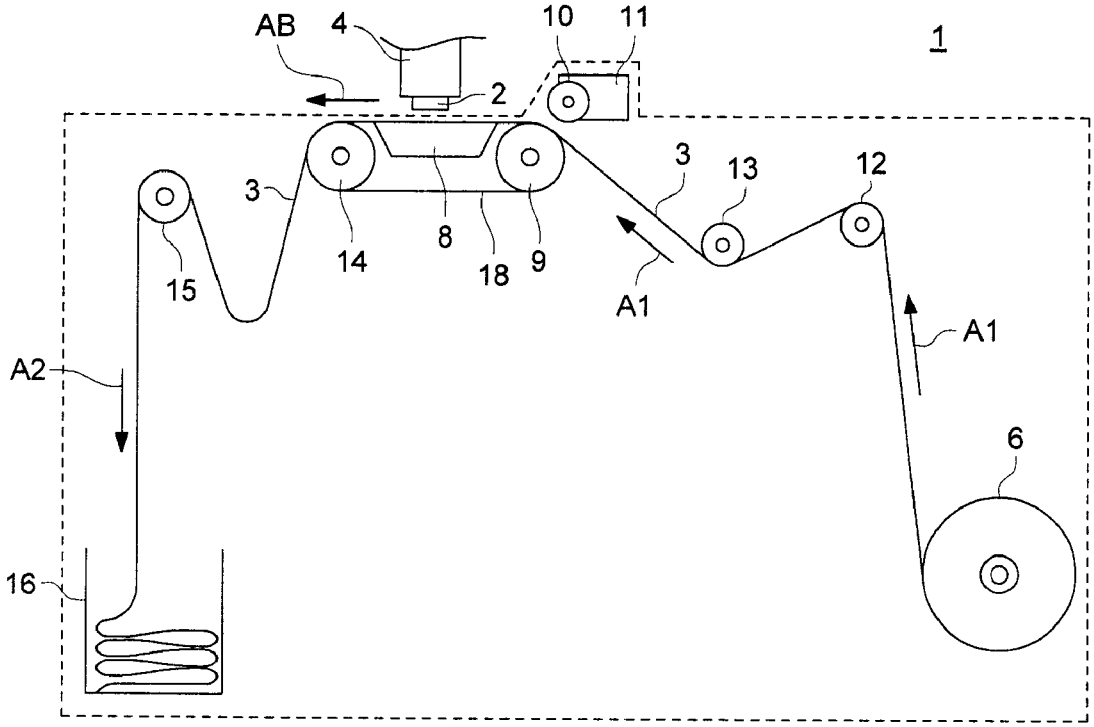
FIG. 1 is a schematic view showing an example of the mechanical constitution of an ink-jet printer according to the first embodiment of the present invention.

The first embodiment of the present invention will now be described with reference to drawings. FIG. 1 is a schematic view showing a structure of fabric printing ink-jet printer-i according to the present invention. Incidentally, the present invention is described while considering that the "recording medium", as described herein, refers to "fabric". However, it does not mean that the present invention is limited to the embodiments.

Fabric printing ink-jet printer-1 is provided with a plurality of nozzles, a pressure chamber connected to these nozzles, and recording head 2 which jets or ejects ink from the nozzles. Ink injection from the recording head 2 is basically realized by generating pressure variation in the pressure chamber. Widely known as mechanisms to result in the pressure variation is one in which by utilizing distortion generated by applying suitable electric signals to a piezo element, displacement (being force variation) is employed (piezo system), and another one in which pressure due to expansion which is generated by providing heat to the pressure chamber is employed (thermal or bubble jet system). Further, a plurality of recording heads 2 is generally provided to correspond to a plurality of colors.

The recording head 2 is manipulated by carriage 4 which is capable of rendering it to scan in the perpendicular direction (in FIG. 1, the direction perpendicular to the paper surface) to the conveying direction of fabric 3. Further, in the fabric printing ink-jet printer-1, image drawing table 8, having a flat and smooth surface, is provided and faces recording head 2, and fabric 3 is fed onto the upper surface of the image drawing table 8.

As a conveying means to convey fabric 3, in the vicinity of one end (the right end in FIG. 1) of the image drawing table 8 in the upstream side of the conveying direction, endless belt 10 is entrained about cylindrical conveying roller 9 and feed-out roller 14.

Conveying roller 9 is axially secured employing a frame or panel of sufficient strength and rigidity, which is not shown in fabric printing ink-jet printer-1 so that the highest position of the circumferential portion of the conveying roller 9 does not project higher than the upper surface of image drawing table 8, and is rotated counterclockwise in FIG. 1, employing a driving means, not shown. Further, pressure roller 10 is provided above conveying roller 9 in FIG. 1, and is rotatably secured employing pressing means 11. Fabric 3 and endless belt 18 are nipped between the pressure roller 10 and the conveying roller and a specified pressure is applied. Employing these two rollers 9 and 10, endless belt 18 is subjected to circulation by the rotation of conveying roller 9, whereby fabric 3 is fed onto the upper surface of image drawing table 8 and conveyed to the position of the recording head 2.

Further, in the vicinity of the other end (the left end in FIG. 1) of the image drawing table 8 which is located downstream in the conveying direction of fabric 3 from the position of recording head 2, feed-out roller 14 is provided, which secures fabric 3 which, after printing, is conveyed from image drawing table 8. Incidentally, the feed-out roller 14 is arranged in almost the same manner as the conveying roller 9 so that the highest position of the outermost circumferential portion of the roller 14 is the same as the upper surface of image drawing table 8 or higher than that. Thus fabric 3 is conveyed parallel to the upper surface of image drawing table 8, employing endless belt 18 which is entrained about rollers 9 and 14. Still further, feed-out roller 15 rotates and is arranged downstream in the conveying direction when viewed from feed-out roller 14.

On the other hand, herein, fabric 3 is a belt-shaped recording medium, and long fabric roll 6 of the fabric 3 is disposed at the most upstream position in the conveying direction of the fabric 3 as viewed from the conveying roller 9 and pressure roller 10. Further, for example, the long fabric roll 6 is disposed near the floor surface wherein fabric printing ink-jet printer-1 is arranged, and is removably secured to the frame, not shown, which is comprised of a durable structure to allow the long fabric roll 6 to rotate axially. In addition, feed-out roller 12 and tension roller 13 is arranged in the order upstream in the conveying direction of fabric 3 between the long fabric roll 6, conveying roller 9, and the like.

Feed-out roller 12 is rotatably secured on the frame of fabric printing ink-jet printer 1 or on a panel having enough rigidity. Tension roller 13 is rotatably secured on, for example, a roller position varying means, not shown, and the roller 13 is constituted so as to allow it to rise and fall between the same height as the upper end portion of the conveying roller 9 and the position lower than the feed-out roller 12. As can been seen from FIG. 1, when tension roller 13 is arranged at a position lower than feed-out roller 12, suitable tension is applied to fabric 3.

By employing the constitution as above, fabric printing ink-jet printer-1 in the present embodiment realizes the following actions. Fabric 3, which is unwound from long fabric roll 6, is conveyed in the direction shown by arrow Al in FIG. 1, passes over feed-out roller 12 and under tension roller 13, and reaches conveying roller 9. Fabric 3 conveyed as above is nipped between endless belt 18 along with conveying roller 9 as well as pressure roller 10, and subsequently is conveyed to the upper surface of image drawing table 8, as shown by arrow AB in FIG. 1. Corresponding to the progress of the conveyance, scanning by carriage 4 is suitably controlled and ink is ejected from recording head 2, whereby ink jet printing is carried out onto the fabric 3.

Fabric 3, which has been subjected to ink jet printing, passes over feed-out roller 15 located further downstream, subsequently is conveyed in the direction shown by arrow A2 in FIG. 1, and is stored in fabric housing means 16.

Incidentally, the fabric printing ink-jet printer-1 of the present embodiment is provided with the following characteristic constitution, other than that above.

Figure 2:
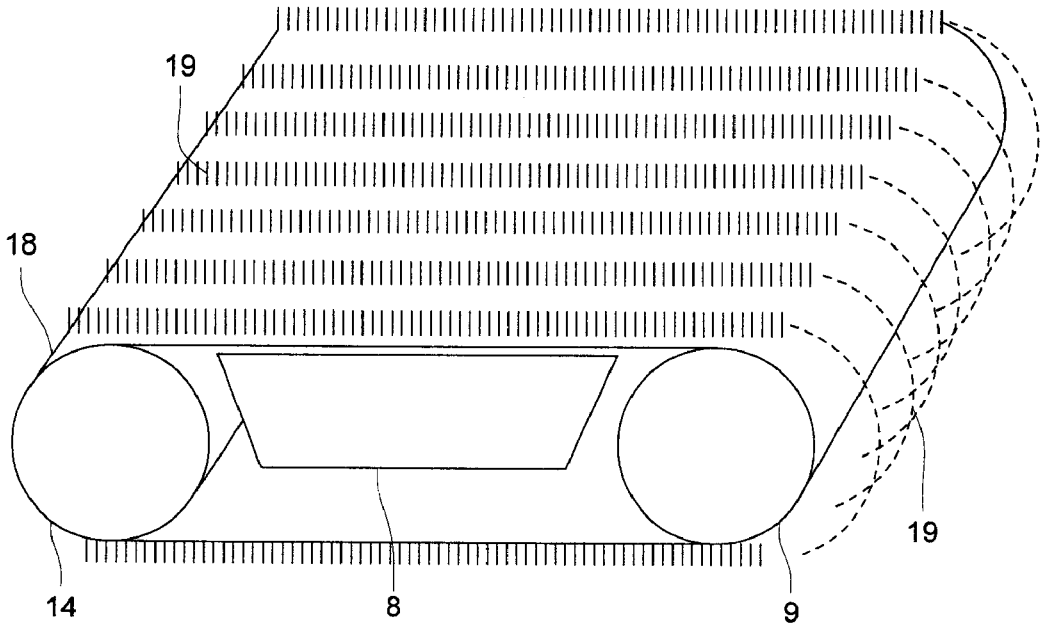
FIG. 2 is a schematic view showing an endless belt, in which projections are formed on the entire surface, which constitutes the ink-jet printer shown in FIG. 1.
Figure 3:
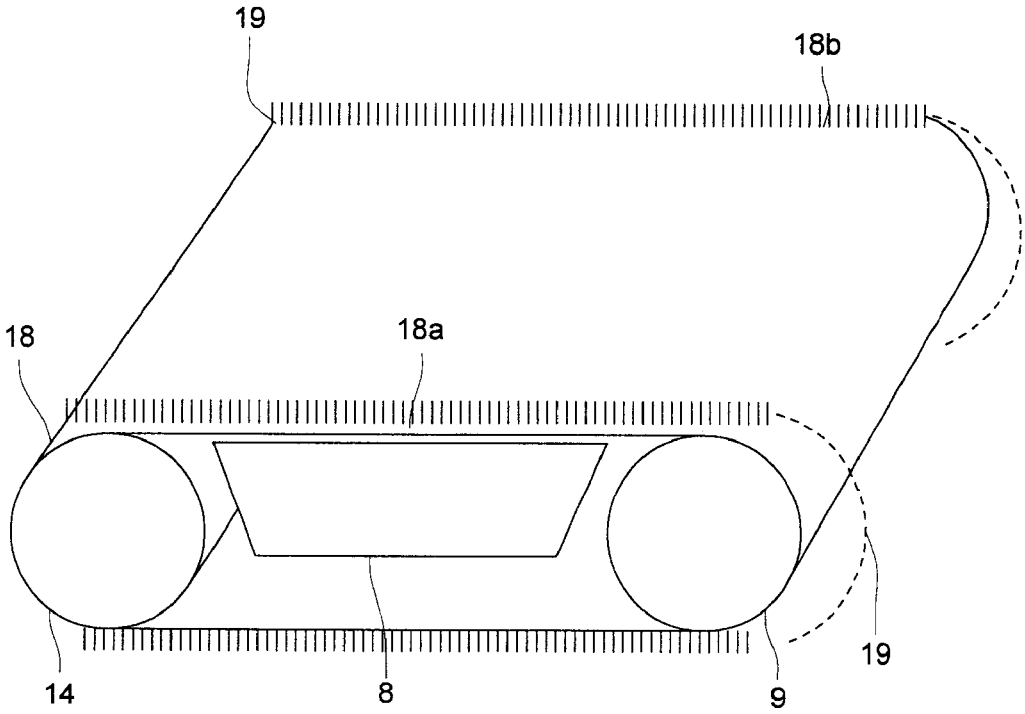
FIG. 3 is a schematic view showing an endless belt, in which projections are formed on both edges, which constitutes the ink-jet printer shown in FIG. 1.

Namely, a characteristic point is that projections 19 are fixedly formed as projections (being a recording medium elongation and shrinkage minimizing means) on the surface of endless belt 18. The projections 19 are formed on, for example, the entire surface of endless belt 18, as shown in FIG. 2. Of course, the projections 19 may be uniformly formed on the entire surface of endless belt 18. Further, in addition, as shown in FIG. 3, projections 19 may be only formed along both edges 18*a* and 18*b* on the surface of endless belt 18. Incidentally, in FIGS. 2 and 3, each of projections 19 corresponds to each of the short lines, and the projections 19 on the curved portions of endless belt 18 wound on conveying roller 9 as well as feed-out roller 14 are abbreviated.

Specific examples of constitution of projections 19 (their materials and shape) include, for example, needles (needle-shaped member) which are adhered or mechanically fixed onto the surface of endless belt 18. Further, projections 19 may be formed by adhering or fixing materials comprised of solid materials such as metal based particles (hereinafter referred to as "metallic particles"), ceramics based particles (hereinafter referred to as "ceramics particles") or hard plastic based particles (hereinafter referred to as "hard plastic particles"). When metallic particles, ceramics particles, or hard plastic particles are employed for projections 19, from the viewpoint of production efficiency, the following compositions are preferred. Such particles are kneaded into suitable media such as adhesives and resins, and is coat-adhered or coated onto the surface of endless belt 18, or a member is prepared by kneading metallic particles, ceramics particles, or hard plastic particles into suitable media such as rubber and resins, and the resulting member is adhered onto the surface of endless belt 18.

Further, other specific examples of composition of projections 19 include the following. For example, projections 19 may be hairs comprised of fibers. Specifically, endless belt 18 (or at least its surface) may be comprised of materials such as suitable felt materials. Furthermore, the resultant surface is subjected to suitable treatment so as to result in a so-called nap-rising state, which corresponds to the hairs. Further, the surface of endless belt is subjected to hair plantation employing suitable methods, which corresponds to the hairs.

In the present embodiment constituted as above, fabric 3, which is brought into contact with the surface of endless belt 18 on which surface projections 19 are formed, is maintained on the surface of the endless belt 18, and is conveyed under recording head 2 in conjunction with the movement of endless belt 18. During the process, projections 19 are brought into contact with fabric 3. As a result, deformation of the fabric 3 is minimized. More specifically, the action (action to minimize elongation and shrinkage of the fabric 3), which minimizes elongation and shrinkage due to conveyance, is exhibited.

Figure 4:
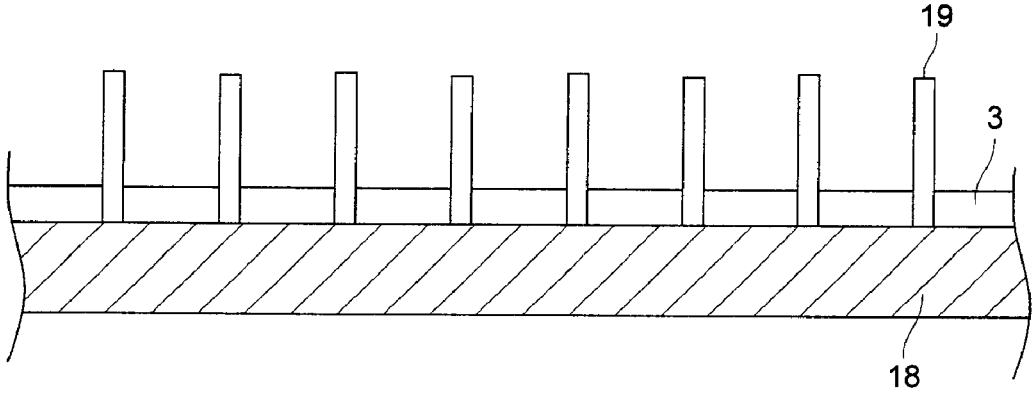
FIG. 4 is a partial cross-sectional view showing the relationship between the fabric conveyed by the endless belt and projections.
Figure 8:
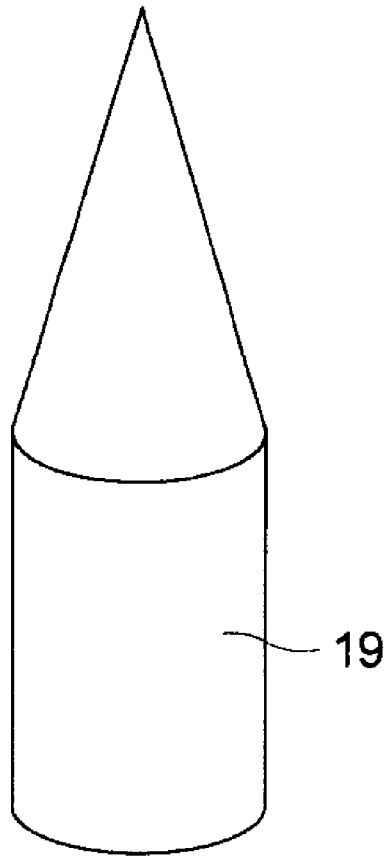
FIG. 8 is a view of showing the shape of a needle used as a projection.
Figure 9:
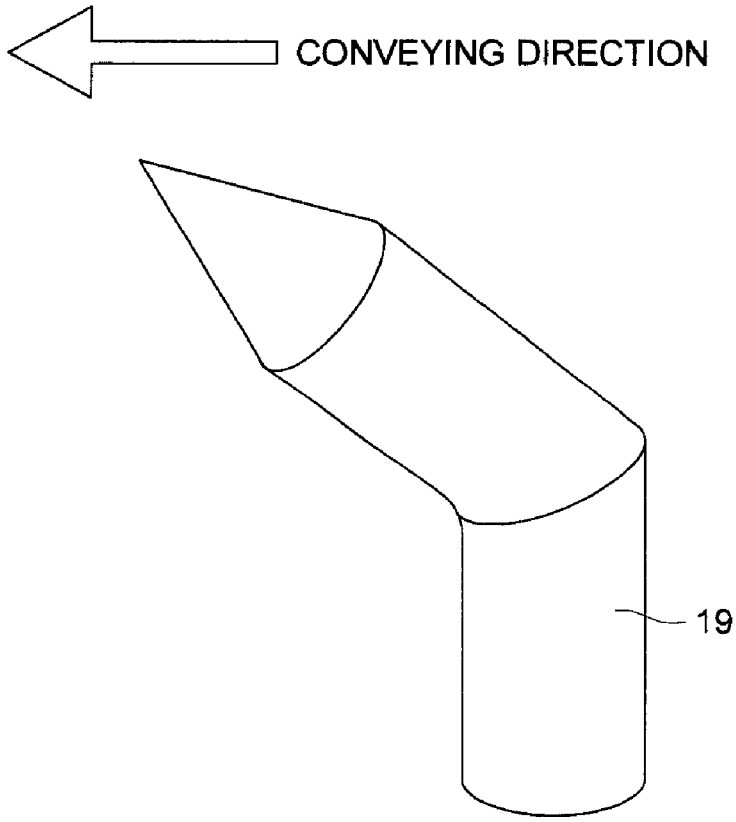
FIG. 9 is a view showing another shape of a needle used as a projection.

For example, when projections 19 are the needles, as shown in the enlarged view of FIG. 4, the needles pass through fabric 3 whereby elongation as well as shrinkage of fabric 3 is retarded. Further, as shown in the enlarged view of FIG. 8, by sharpening the tip of the needle, needles are readily put into fabric 3, whereby conveying properties are enhanced, while needle marks are not easily formed. Further, as shown in the enlarged view of FIG. 9, by bending the needle downstream in the conveying direction or slanting it, the needle easily secures fabric 3 whereby it is possible to carry out more stable conveyance.

Further, when projections 19 are comprised of the solid materials, by employing metallic particles, ceramics particles, or hard plastic particles having corners, the fabric 3 is easily secured, whereby it is possible to carry out stable conveyance.

Figure 5:
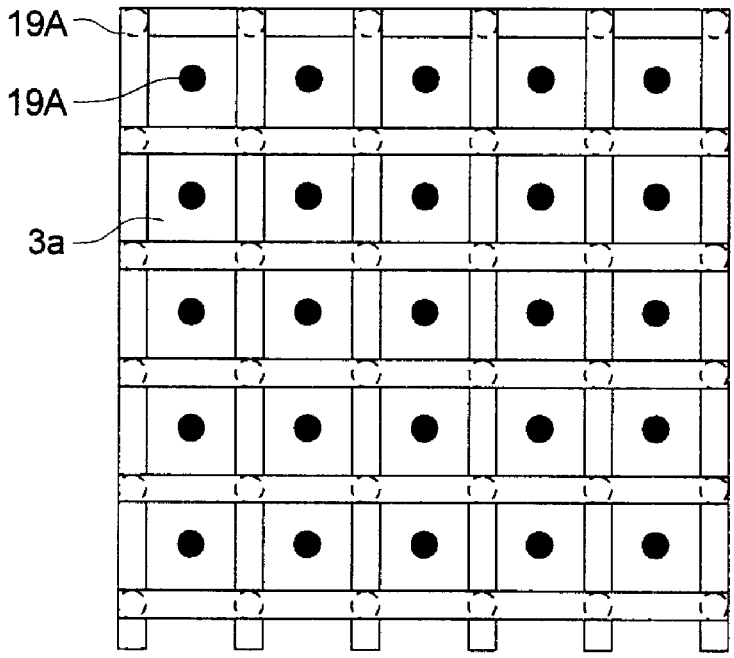
FIG. 5 is a view explaining a situation in which the number of hairs (projections) is more than the number of fine lines of the fabric (recording material)

Still further, when projections 19 are the hairs, the hairs come into contact with fabric 3, and friction between them increases (becoming difficult to move relative to each other). As a result, deformation, as well as elongation and shrinkage, of fabric 3 is retarded. Still further, as shown schematically in FIG. 5, it is preferable that the number of implanted hairs 19A is adjusted so as to be more than the number of lines 3*a* between strings (herein, referred to as the spaces between woven fibers), while taking into account the number of lines between strings per unit area of conveyed fabric 3. In FIG. 5, when the rectangle is regarded as a unit area, the number of hairs 19A is "61", while the number of lines 3*a* between strings is 25. By so doing, hairs are increasingly catch fabric 3, whereby fabric 3 may be more effectively prevented from deformation as well as elongation and shrinkage. Still further, when the hairs are erected, it becomes more difficult to move fabric 3, whereby deformation and elongation as well as shrinkage are optimally minimized.

On the other hand, in order to minimize drop of the hairs from endless belt 18, it is preferable that the diameter of conveying roller 9 and feed-out roller 14 is at least ϕ40 mm, and that the radius of curvature of endless belt 18 is set to at least 20 mm.

Accordingly, fabric 3 is always conveyed by endless belt 18 under a definite state, as if it were adhered onto the surface of endless belt 18, whereby ink ejection, employing, for example, recording head 2, is always carried out at a suitable position. As a result, by employing fabric printing ink-jet printer-1 of the embodiment of the present invention, images, which result in undesired deformation such as partial elongation or partial shrinkage, are not formed. Thus, it is possible to carry out the desired image formation. Further, it is preferable that endless belt 18 be provided farther downstream than the image forming region. By providing the endless belt 18 farther downstream than the image forming region, the conveyance of fabric 3 in the image forming region, employing recording head 2, is not affected by the non-uniform conveyance between the portion having projections 19 and the portion having such projections. As a result, it is possible to carry out the desired image formation.

Still further, in the present invention, accepted as structures to provide the endless belt 18 may be various ones described below, with the aim of realizing more assured working effects of the same.

Figure 10:
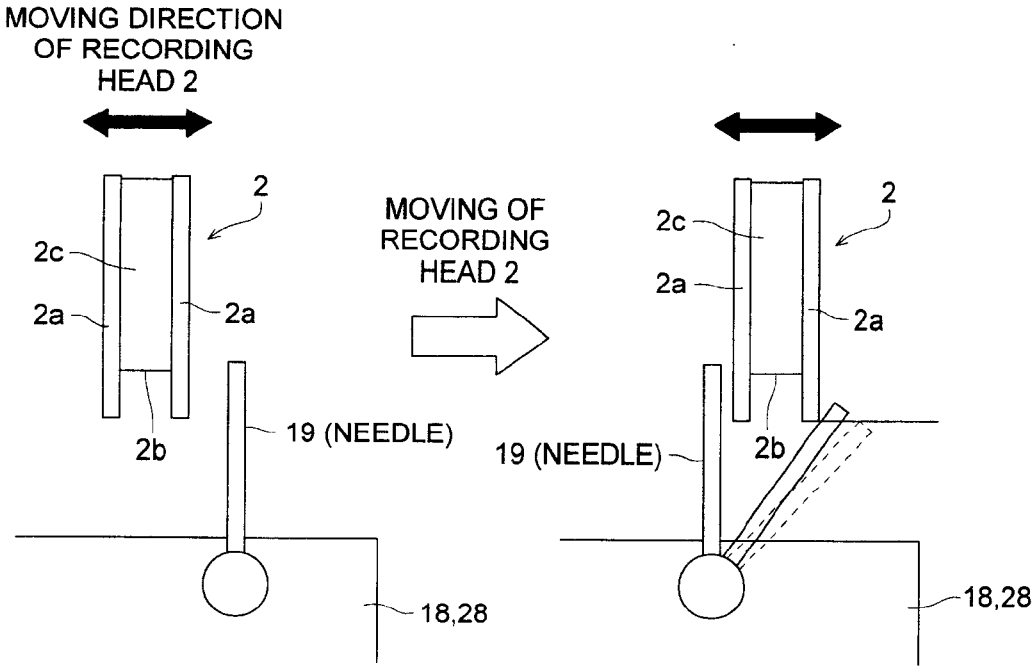
FIG. 10 is a view explaining the configuration of a needle (projections) during movement of a recording head.

For example, as shown in FIG. 10, projections 19 are provided at both edges on the surface of the endless belt. In order to be assuredly caught by fabric 3, for example, when the length of the aforethe needles is increased, the tip of the needles is brought into contact with nozzle surface 2*b* of nozzle plate 2*c* in which the nozzle to eject ink of recording head 2 is formed. As a result, the ink injecting state from the nozzle varies. Further, the nozzle may be damaged by such contact. Accordingly, when recording head 2 moves and subsequently passes above the needles, it is necessary to position the needles so as to not come into contact with the nozzle plate 2*b*. Specifically, as shown in FIG. 10, the surface of the endless belt 18 is formed employing an elastic body such as rubber, and needles are secured into the surface so that the needles can readily rise and fall. On the other hand, in the recording head, guard member 2*a* is provided so that its projection is higher than nozzle surface 2*b* while nipping nozzle plate 2*c* in the moving direction of recording head 2. By so doing, when the recording head 2 moves and subsequently passes above the needles, the needles are brought down by the guard 2*a* so as to not come into contact with the nozzle surface 2*b*. As a result, it is possible to increase the length of the needles. Accordingly, it is possible to carry out the stable conveyance of fabric 3.

Figure 11:
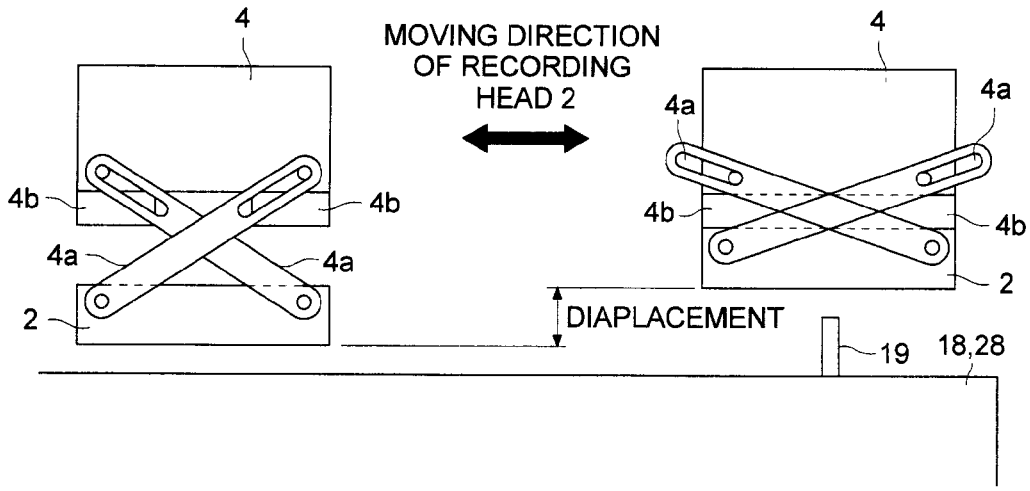
FIG. 11 is a view explaining the situation of recording head displacement during movement above a needle (projections)

Further, in another specific example, when recording head 2 moves and subsequently passes above the needles, the recording head 2 may change its direction parting from the needles so that the needles do not come into contact with nozzle surface 2*b*. For example, as shown in FIG. 11, recording head 2 is suspended from carriage 4 via link 4*a* and for example, the recording head may be displaced employing electromagnet 4*b*. As a result, it is possible increase the length of needles, and thereby it making possible to carry out the desired stable conveyance of fabric 3.

Figure 6:
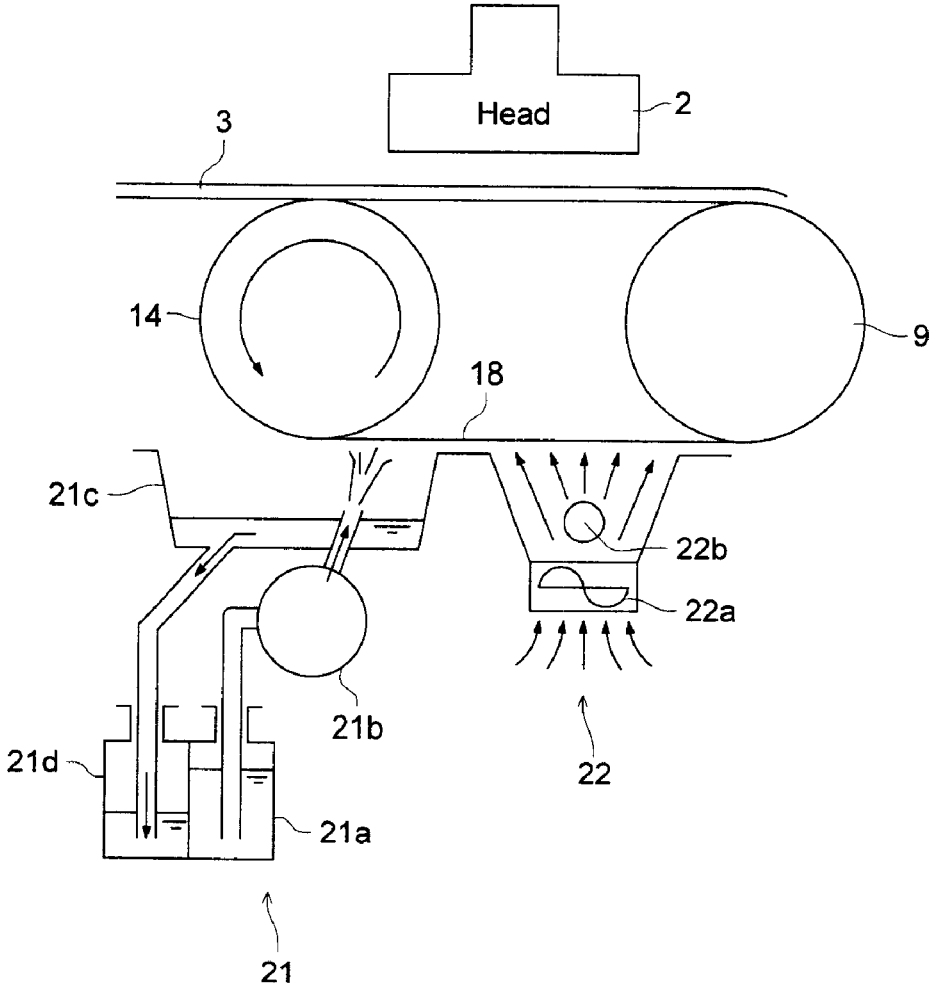
FIG. 6 is a schematic view showing an example of the structure of a washing unit and a drying unit which are means to prevent the re-adhesion of any ink adhered onto the endless belt and hairs (projection) to the fabric.

In addition, from the viewpoint of maintaining quality of images formed on fabric 3, it is preferable that a means (being a re-adhesion preventing means) is provided which minimizes re-adhesion of ink adhered onto endless belt 18 as well as hairs onto fabric 3. Employed as such specific means may be a structure comprised of washing device 21 (being a washing means) which washes endless belt 18 as well as the hairs by spraying water or washing liquid, as shown in FIG. 6, and a structure comprised of a washing device along with drying device 22 (being a drying mean) which dries endless belt 18 as well as hairs after washing. Incidentally, in FIG. 6, the washing device 21 is provided with washing liquid tank 21*a*, pump 21*b*, washing effluent receiving tray 21*c*, and effluent storage tank 21*d*, while drying device 22 is provided with air blowing fan 22*a* and heater 22*b*.

Figure 12:
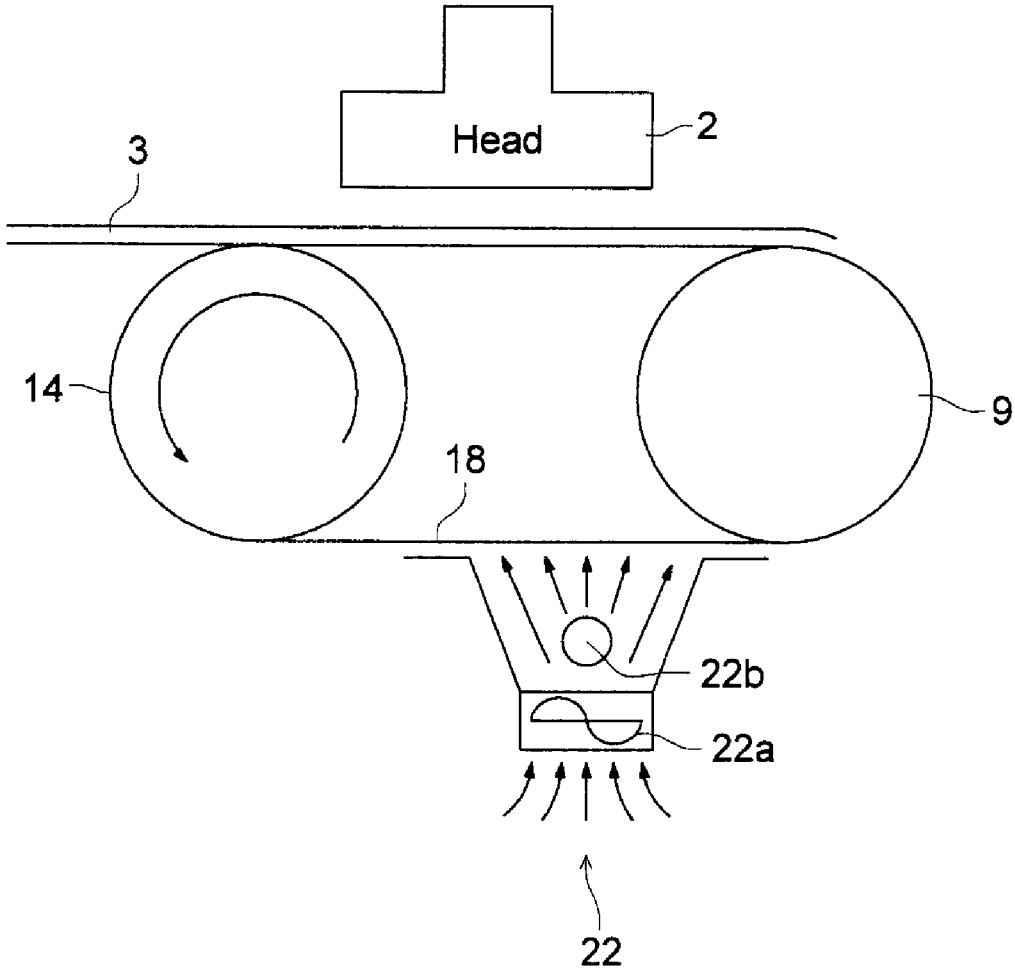
FIG. 12 is a schematic view showing an example of the structure of an ink absorbing member which is a means to prevent re-adhesion of any ink adhered onto the endless belt as well as hairs (projections) onto a respective fabric.

Further, in still another example, as shown in FIG. 12, it is possible to employ a structure in which only drying device 22 is provided which dries ink, adhered onto endless belt 18 as well as hairs, without contact. In such a case, ink is not removed from the surface of the endless belt 18. However, since the ink is hardened by drying, it is possible to retard the re-adhesion of ink onto fabric 3. Preferably employed as heater 22*b* in drying device 22 may be one generating far-infrared rays which exhibit relatively high heating effects. Specific examples, which generate far-infrared rays, include far-infrared heaters as well as halogen heaters. When these heaters are employed, it is possible to adjust the temperature to the desired range at relatively low power. As a result, it is possible to lower operation cost.

Figure 13:
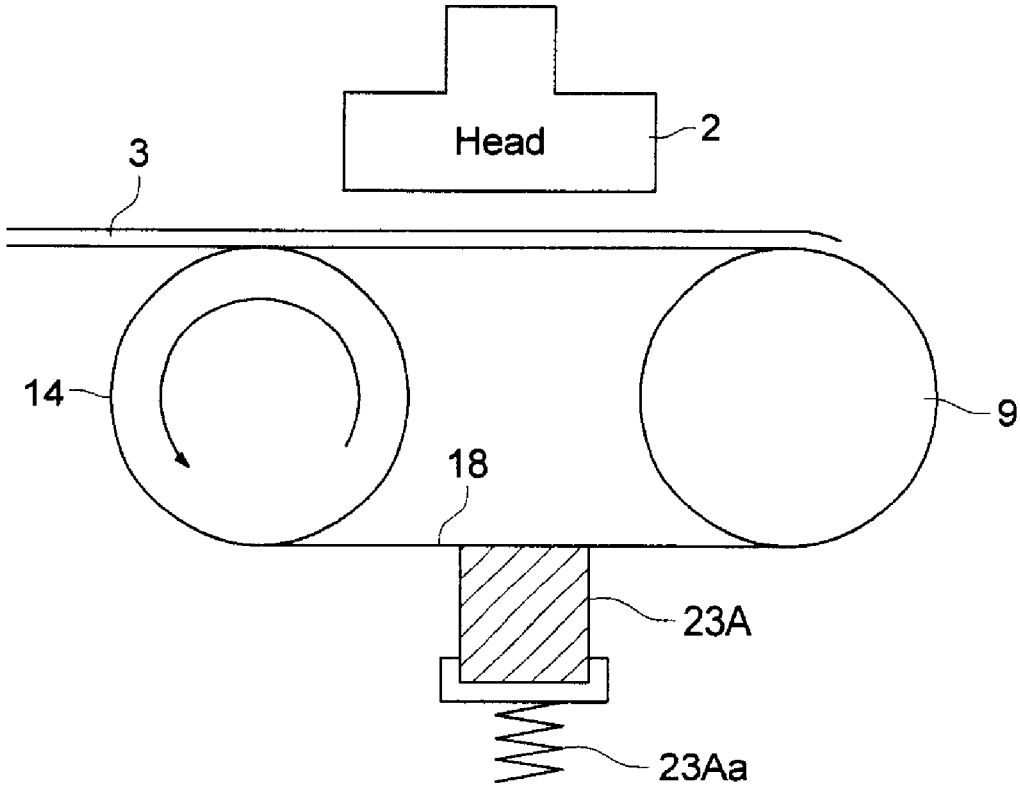
FIG. 13 is a schematic view showing an example of the structure of an ink absorbing member, which is a means to prevent re-adhesion of ink adhered onto the endless belt as well as hairs (projections) onto a respective fabric.

In still another example, as shown in FIG. 13, it is possible to minimize re-adhesion of adhered ink onto fabric 3 by utilizing a structure in which absorbing member 23A, which absorbs ink, is brought into pressure contact with the endless belt employing a pressing means such as spring 23Aa. Such a structure, employing the absorbing member, makes it possible to lower costs still further.

Figure 7:
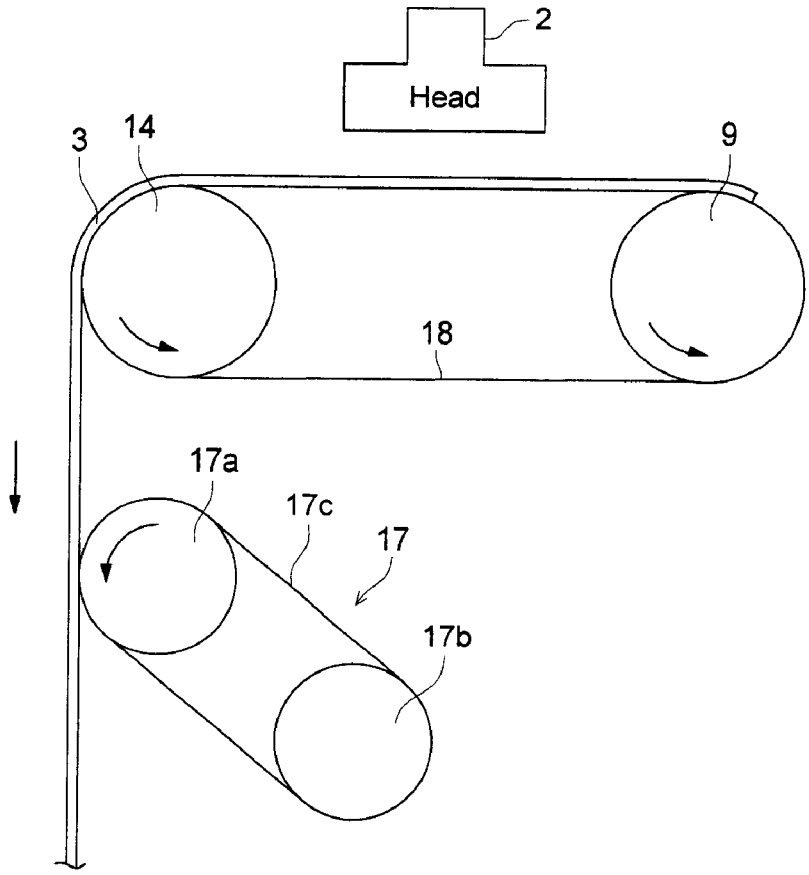
FIG. 7 is a view of the embodiment in which double-sided tape, according to the first embodiment of the present invention, is used as a removing means.

In addition, it is more preferable that a means (a removal means) is provided which removes projections which have dropped from endless belt 18 and subsequently adhered onto fabric 3, and especially removes hairs when hairs are employed as projections. Specifically considered as the removal means is the structure shown in FIG. 7. The structure shown in FIG. 7 is such that the inner surface of fabric 3 on the downstream side, conveyed while placed on endless belt, is brought into contact with double-sided adhesive tape 17*c* entrained about drive roller 17*a* and driven roller 17*b*, whereby hairs adhered on the inner surface of the fabric 3 are removed.

Figure 14:
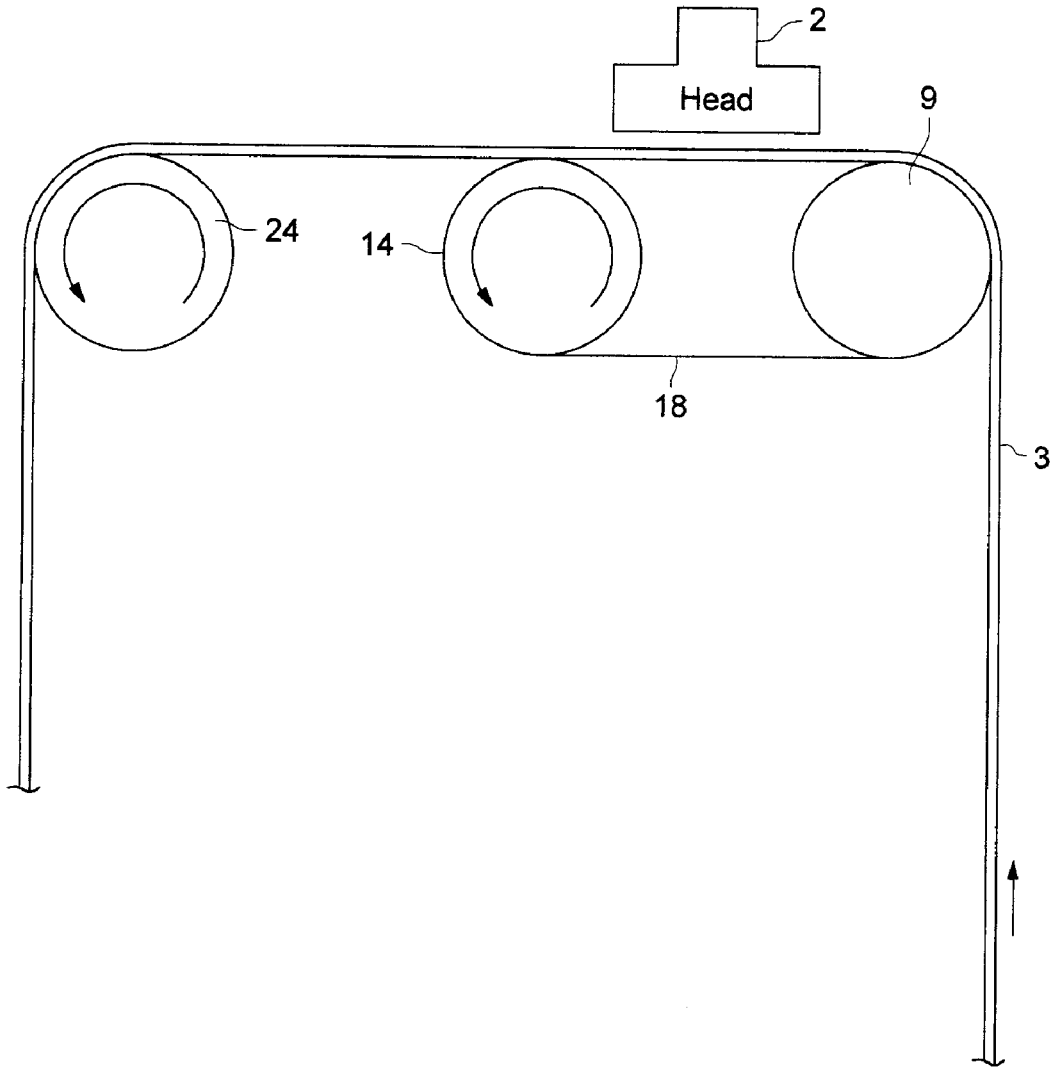
FIG. 14 is a view showing an embodiment in which a cleaning roller, according to the first embodiment of the present invention, is used as a removing means.

Other examples of the removal means may include structures in which, as shown in FIG. 14, fabric 3 is introduced onto cleaning roller 24 and fabric 3 is conveyed by cleaning roller 24. Considered as specific examples of the cleaning roller 24 are a roller of which surface is adhered with double-sided adhesive tape, a roller to which surface glue or adhesives are applied, and an adhesive rubber roller.

Figure 15:
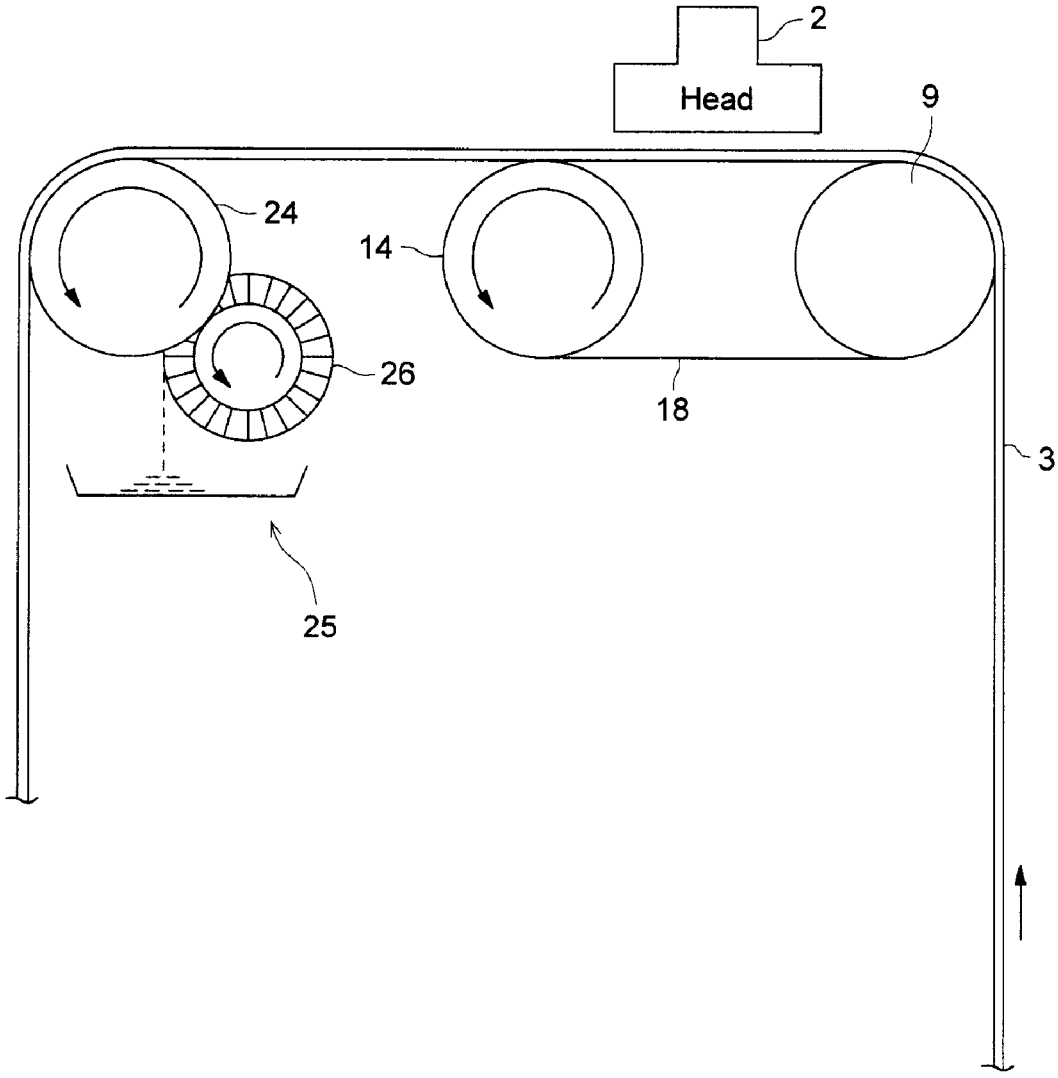
FIG. 15 is a view showing an embodiment in which the cleaning roller according to the first embodiment of the present invention is provided with a brush roller as a retrieving means.
Figure 16:
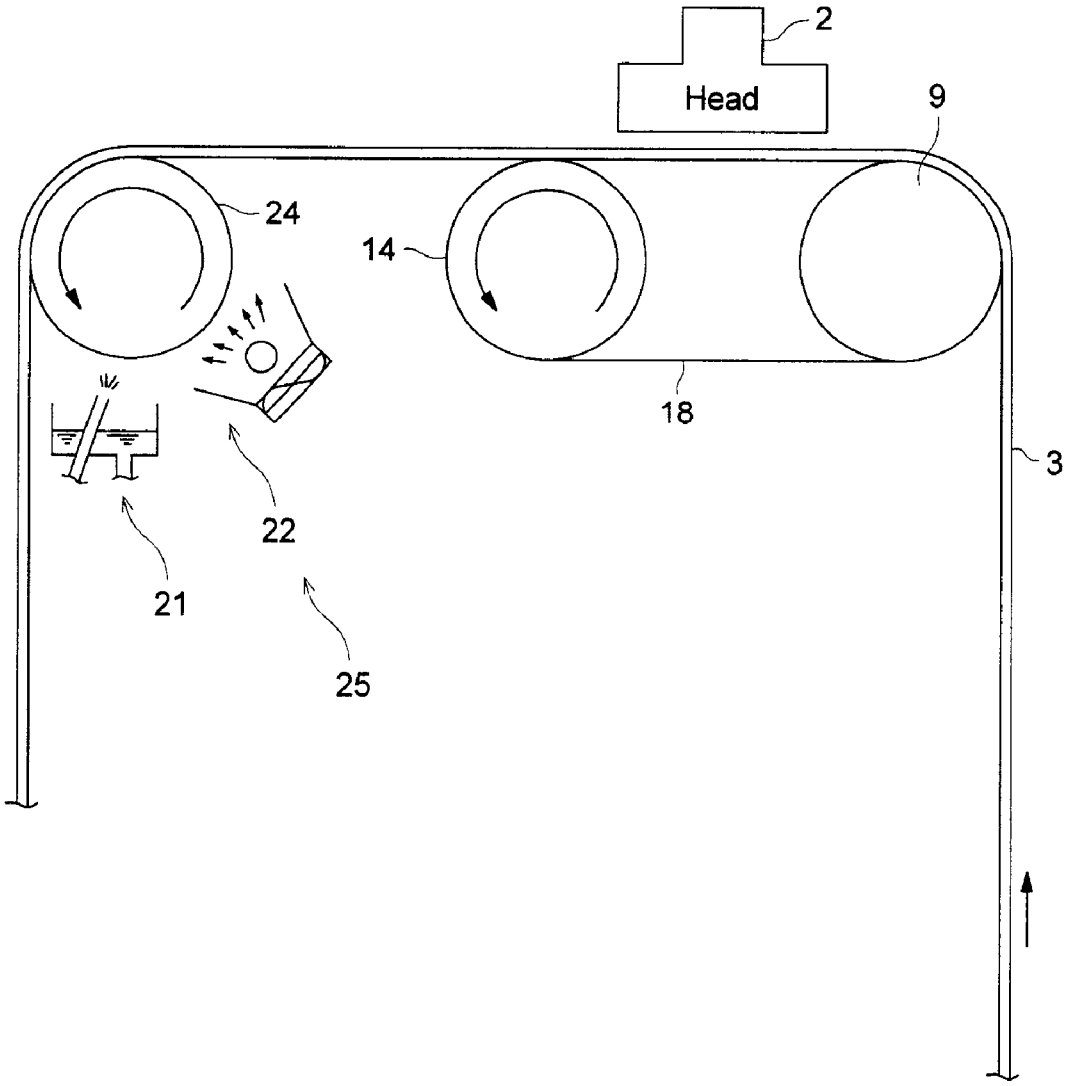
FIG. 16 is a view showing an embodiment in which the cleaning roller, according to the first embodiment of the present invention, is provided with a washing unit and a drying unit as a retrieving means.
Figure 17:
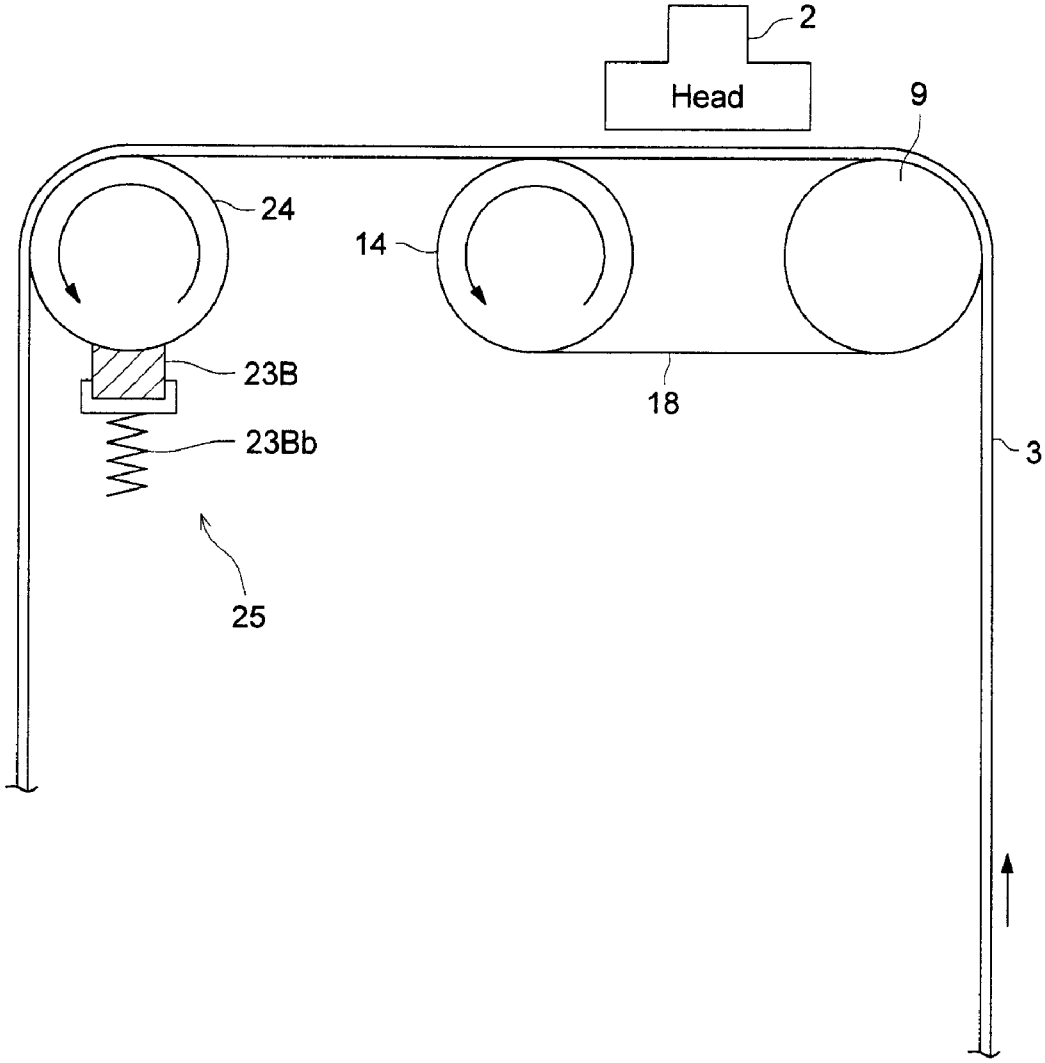
FIG. 17 is a view showing an embodiment in which the cleaning roller, according to the first embodiment of the present invention, is provided with an absorbing member as a retrieving means.

It is further preferable that hairs, which are removed from the surface of fabric 3 and remained on the removal means, are recovered by recovery means 25. Incidentally, the recovery means 25 is capable of recovering hair removing function of the removal means. Considered as specific examples of the recovery means 25 are one in which, as shown in FIG. 15, cleaning roller 24 is rotated through contact with brush roller 26 so that hairs adhered on the cleaning roller 24 are scraped off, and one which, as shown in FIG. 16, is provided with the washing device 21 (being a washing means) as well as drying device 22 (being a drying means), and one in which, as shown in FIG. 17, absorbing member 23B is brought into pressure contact with cleaning roller 24, employing a pressing means such as spring 23Bb. For example, by employed urethane foam, hairs can be trapped into cavities of the urethane foam.

Figure 18:
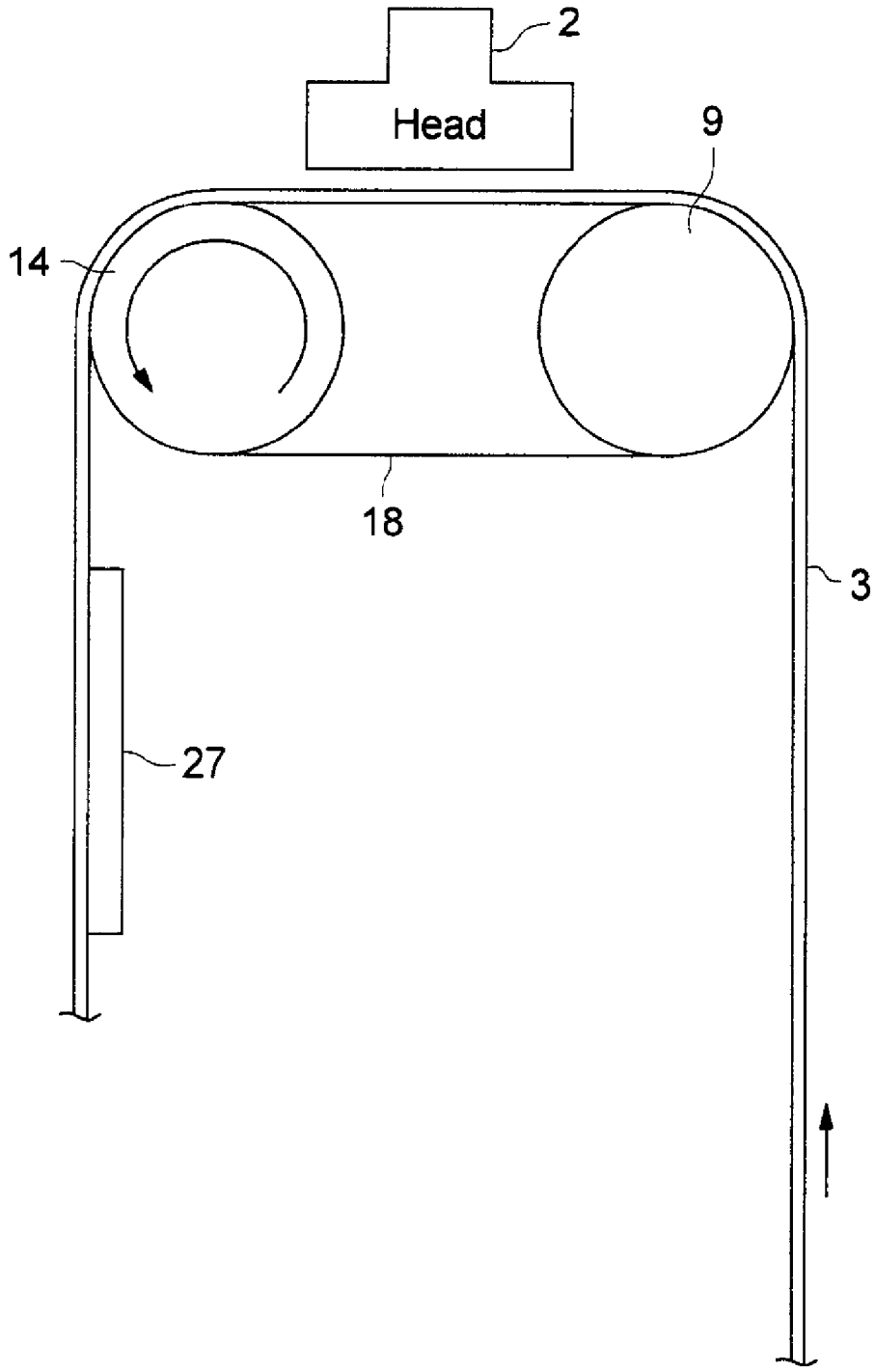
FIG. 18 is a view showing an embodiment in which an electrostatic adhesion plate, according to the first embodiment of the present invention, is used as a retrieving means.

Further, still another example of the removal means includes a structure in which, as shown in FIG. 18, electrostatic adhesion plate 27 is brought into contact with the inner surface of fabric 3 and when the fabric 3 moves on the surface of the electrostatic adhesion plate 27, hairs adhered on the inner surface of the fabric 3 may be removed utilizing electrostatic adhesion force. Since the electrostatic adhesion plate 27 employs no consumable materials, it can be easily reused.

Incidentally, structures and functions as above are described regarding needles or implanted hairs on endless belt 18. However, needless to say, the above description is basically applicable to any projections such as the needles, solid materials, and hairs which are formed on endless belt 18.

Incidentally, in the present invention, effects as above may be obtained employing an endless belt which does not comprise projections as above. Specifically, for example, the portion of the endless belt which comes into contact with the fabric 3 may be formed employing rubber materials which exhibit relatively high friction against the fabric 3. Herein, listed as rubber materials are EPDM, silicone rubber, and adhesive rubber (in this case, the entire endless belt 18 corresponds to "recording medium expansion and contraction-preventing means", as described in the present invention). Even in such a case, both elongation and shrinkage of fabric 3 are minimized because fabric 3 conveyed while brought into semi-contact with the rubber material, having a relatively high friction, is subjected to limitation against free dimensional change. Accordingly, even in this case, images are not partially elongated nor shortened, whereby it is possible to carry out the desired quality image formation.

Further, as is initially pointed out in the description of the embodiments of the present invention, the present invention is not limited to fabric 3 as a recording medium. Namely, in principle, it is possible to apply the present invention to paper and various sheets even though "recording medium" include these. In addition, it is assumed the almost the same effects as above are exhibited when these are employed. However, it is pointed out that the present invention exhibits the most desired effects when ink jet printing is carried out employing fabric 3.

(Second Embodiment)

Figure 19:
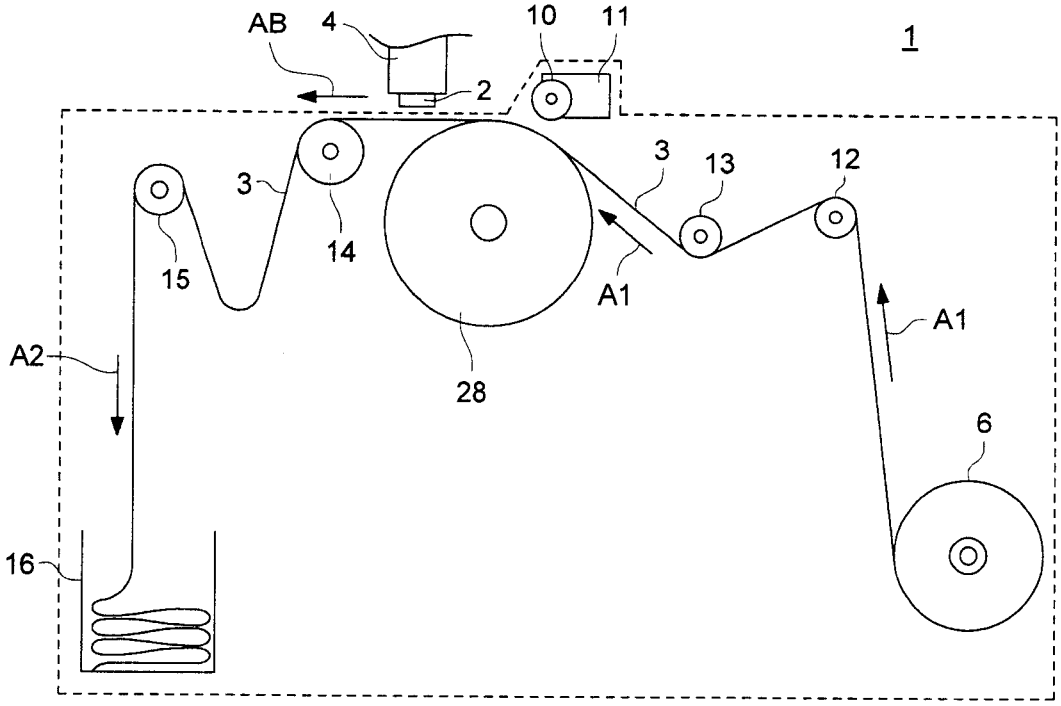
FIG. 19*a* schematic view showing an example of the mechanical constitution of the ink-jet printer according to the first embodiment of the present invention.

The second embodiment of the present invention will now be described with reference to respective drawings. FIG. 19 is a schematic view showing a structure of fabric printing ink-jet printer-1 according to the present invention. Incidentally, in the present embodiment, the present invention is described while considering that the "recording media", as described herein, refers to "fabric". However, it does not mean that the present invention is limited to the embodiment. Incidentally, the same numerals are used for the same items as those in the first embodiment.

Fabric printing ink-jet printer-1 is provided with a plurality of nozzles, a pressure chamber connected to the nozzles, and recording head 2 which jets or ejects ink from the nozzles. Ink ejection from the recording head 2 is basically realized by generating pressure variation in the pressure chamber. Widely known as mechanisms to result in the pressure variation is one which utilizes distortion generated by applying suitable electric signals to a piezo element, and the resultant displacement (being a force variation) is employed (piezo system), and another one in which pressure due to expansion, which is generated by providing heat to the pressure chamber, is employed (thermal or bubble jet system). Further, a plurality of recording heads 2 is generally provided corresponding to a plurality of colors.

The recording head 2 is maintained by carriage 4 which is capable of rendering it to scan in the perpendicular direction (in FIG. 19, perpendicular to the paper surface) to the conveying direction of fabric 3. Further, in the fabric printing ink-jet printer-1, image drawing table 8, having a flat and smooth surface, is provided so as to face recording head 2, and fabric 3 is placed onto the upper surface of the image drawing table 8.

Platen roller 28 is axially secured to a frame or a panel having sufficient strength as well as rigidity, which is not shown, of fabric printing ink-jet printer-1 and is rotated counterclockwise in FIG. 19 by a driving means not shown. Further, pressure roller 10 is provided above platen roller 28 in FIG. 19, and is rotatably secured employing pressing means 11. Fabric 3 and platen roller 28 are nipped between the pressure roller 10 and the conveying roller, and specified pressure is applied to these. Employing these two rollers 28 and 10, fabric 3 is conveyed while facing the recording head 2.

Further, for example, long fabric roll 6 is arranged near the floor surface wherein fabric printing ink-jet printer-1 is arranged, and is movably attached to the frame, not shown, which is comprised of a durable structure to allow the long fabric roll 6 to rotate axially. In addition, between the long fabric roll 6 and platen roller 28, feed-out roller 12 and tension roller 13 are arranged in the order seen from upstream of the conveying direction of the fabric.

Feed-out roller 12 is rotatably secured to the frame of fabric printing ink-jet printer-1 or a panel having enough rigidity. Tension roller 13 is rotatably secured to, for example, a roller position varying means, not shown, and the roller 13 is constituted so as to allow it to elevate and descend between the same height as the upper end portion of the conveying roller 9, and at a position lower than the feed-out roller 12. As can been seen from the drawing, when tension roller 13 is arranged at a position lower than feed-out roller 12, desired tension is applied to fabric 3.

By employing the constitution as above, fabric printing ink-jet printer-1 in the present embodiment realizes the following actions. Fabric 3, which is unwound from long fabric roll 6 is conveyed in the direction of arrow A1 in FIG. 19, passes over feed-out roller 12 and under tension roller 13, and subsequently is conveyed as shown by mark A1 in FIG. 19, and nipped by platen roller 28 and pressure roller 10. Corresponding to the progress of the conveyance, scanning by carriage 4 is suitably controlled and ink is ejected from recording head 2, whereby ink jet printing is carried out on the fabric 3.

Fabric 3, which has been subjected to ink jet printing, passes over feed-out rollers 14 and 15, located further downstream, subsequently is conveyed in the direction shown by arrow A2 in FIG. 19, and is stored in fabric housing means 16.

Incidentally, fabric printing ink-jet printer-1 of the second embodiment is provided with the following characteristic constitution other than that previously described.

Figure 20:
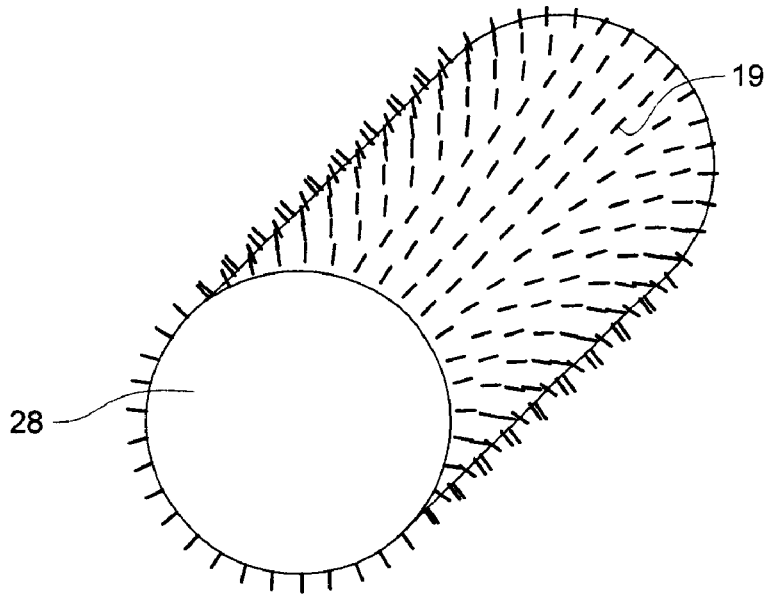
FIG. 20 is a schematic view showing the platen roller, in which projections are formed on its entire surface, which constitutes the ink-jet printer shown in FIG. 19.
Figure 21:
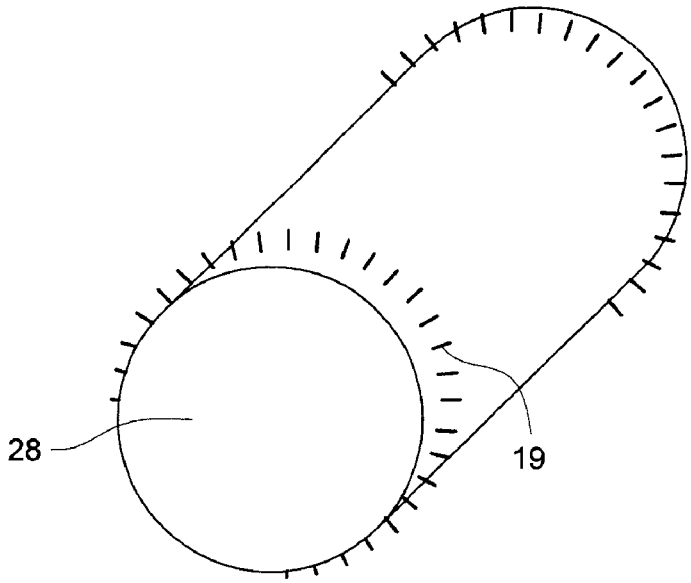
FIG. 21 is a schematic view showing the platen roller, in which projections are formed only on its both edges, which constitutes the ink-jet printer shown in FIG. 19.

Namely, one characteristic is that projections 19 are fixedly formed as projections (being a recording medium elongation and shrinkage minimizing means) on the surface of platen roller 28. The projections 19 are formed on, for example, the entire surface of platen roller 28, as shown in FIG. 20. Of course, the projections 19 may also be uniformly formed on the entire surface of endless belt 18. Further, in addition, as shown in FIG. 21, projections 19 may be formed only along both edges 18*a* and 18*b* on the surface of platen roller 28. Incidentally, in FIGS. 20 and 21, each of projections 19 corresponds to each of the short lines.

Specific examples of the constitution of projections 19 (their materials and shape) include, for example, needles (needle-shaped member) which are adhered or mechanically fixed onto the surface of endless belt 18. Further, projections 19 may be formed in the same manner as above by adhering or fixing materials comprised of solid materials such as metal based particles (hereinafter referred to as "metallic particles"), ceramics based particles (hereinafter referred to as "ceramics particles") or hard plastic based particles (hereinafter referred to as "hard plastic particles"). When the metallic particles, ceramics particles, or hard plastic particles are employed for projections 19, from the viewpoint of production efficiency, the following compositions are preferred. Such particles are kneaded into suitable media such as adhesives or resins, and are coat-adhered or coated onto the surface of endless belt 18, or a member is prepared by kneading metallic particles, ceramics particles, or hard plastic particles into suitable media such as rubber and resins, and the resulting material is adhered onto the surface of endless belt 18.

Further, other specific examples of the composition of projections 19 include the following. For example, projections 19 may be hairs comprised of fibers. Specifically, platen roller 28 (or at least its surface) may be comprised of materials such as suitable felt materials. Furthermore, the resultant surface is subjected to suitable treatment so as to result in a so-called nap-rising state, which corresponds to the hairs. Further, the surface of platen roller 28 is subjected to hair implantation employing suitable methods, which corresponds to the hairs.

In the present embodiment constituted as above, fabric 3, which is brought into contact with the surface of platen roller 28, on which surface projections 19 are formed, is maintained on the surface of the platen roller 28, and is conveyed under recording head 2 through rotation of platen roller 28. During the process, projections 19 are brought into contact with fabric 3. As a result, deformation of the fabric 3 is minimized. More specifically, action (action to minimize elongation and shrinkage of the fabric 3), which minimizes elongation and shrinkage due to conveyance, is exhibited.

Figure 22:
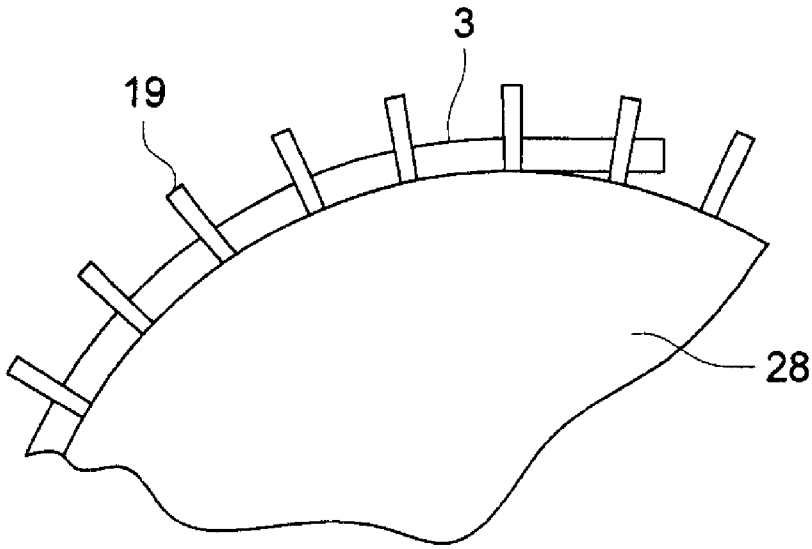
FIG. 22 is a partial cross-sectional view showing the relationship between a fabric and projections conveyed by the platen roller.

For example, when projections 19 are the needles, as shown in the enlarged view of FIG. 22, the needles pass through fabric 3 whereby elongation as well as shrinkage of fabric 3 is retarded. Further, as shown in the enlarged view of FIG. 8, by sharpening the tip of the needle, needles readily penetrate fabric 3, whereby conveying properties are enhanced, while needle marks are not easily formed. Further, as shown in the enlarged view of FIG. 9, by bending the needle downstream in the conveying direction or declining it, the needle easily engages fabric 3, whereby it is possible to carry out more stable conveyance.

Further, when projections 19 are comprised of the solid materials, by employing metallic particles, ceramics particles, or hard plastic particles, having corners, the fabric 3 is easily engaged, whereby it is possible to carry out stable conveyance.

Still further, when projections 19 are the hairs, the hairs come into contact with fabric 3, and friction between them increases (becoming difficult to move relative to each other). As a result, deformation, as well as elongation and shrinkage of fabric 3 are retarded. Still further, as shown schematically in FIG. 5, it is preferable that the number of implanted hairs 19A is adjusted so as to be more than the number of lines 3*a* between strings (herein, referred to the space between woven fibers), while taking into account the number of unwoven lines per unit area of conveyed fabric 3. In FIG. 5, when the rectangle is regarded as a unit area, the number of hairs 19A is "61", while the number of the lines 3*a* between strings is 25. By so doing, hairs are increasingly engaged by fabric 3, whereby the fabric 3 may be more effectively prevented from deformation as well as elongation and shrinkage. Still further, when the hairs are raised, it becomes more difficult to move fabric 3, whereby deformation and elongation as well as shrinkage are more minimized.

Accordingly, fabric 3 is always conveyed by platen roller 28 under a definite state, whereby ink ejection, employing, for example, recording head 2, is always carried out at the appropriate position. As a result, by employing fabric printing ink-jet printer-1 of the embodiment of the present invention, images, which result in undesired deformation such as partial elongation or partial shrinkage, are not produced. Thus, it is possible to carry out desired image formation. Further, it is preferable that endless belt 18 is provided farther downstream than the image forming region. By providing the endless belt 18 farther downstream than the image forming region, the conveyance of fabric 3 in the image forming region, employing recording head 2, is not affected by the non-uniform conveyance formed between the portion having projections 19 and the portion having no projections 19. As a result, it is possible to carry out more desirable image formation.

Still further, in the present invention, accepted as structures to provide the platen roller 28 may be various ones described below while aiming at realizing more assured working effects of the same.

For example, as shown in Table 10, projections 19 are provided along both edges on the surface of the endless belt. In order to be securely caught by fabric 3, for example, when the length of the aforethe needles is increased, the tip of the needles is brought into contact with nozzle surface 2*b* of nozzle plate 2*c*, in which the nozzle to eject ink from recording head 2 is formed. As a result, the ink ejecting state from the nozzle can be varied. Further, the nozzle may thereby be damaged. Accordingly, when recording head 2 moves and subsequently passes above the needles, it is necessary to position the needles so as to not come into contact with the nozzle plate 2*b*. Specifically, as shown in FIG. 10, the surface of the endless belt 18 is formed employing an elastic body such as rubber, and needles are implanted into the surface so that the needles can be readily raised and brought down. On the other hand, in the recording head 2, guard member 2*a* is provided so that its projections is higher than nozzle surface 2*b* while nipping nozzle plate 2*c* in the moving direction of recording head 2. By so doing, when the recording head 2 moves and subsequently passes above the needles, the needles are brought down by the guard 2*a* so as to not come into contact with the nozzle surface 2*b*. As a result, it is possible to increase the length of the needles. Accordingly, it is possible to carry out stable conveyance of fabric 3.

Further, in another specific example, when recording head 2 moves and subsequently passes above the needles, the recording head 2 may change its direction parting from the needles so that the needles do not come into contact with nozzle surface 2*b*. For example, as shown in FIG. 11, recording head 2 is suspended from carriage 4 via link 4*a* and for example, the recording head may be displaced employing electromagnet 4*b*. As a result, it is possible increase the length of needles, and thus, it is possible to carry out the desired stable conveyance of fabric 3.

Figure 23:
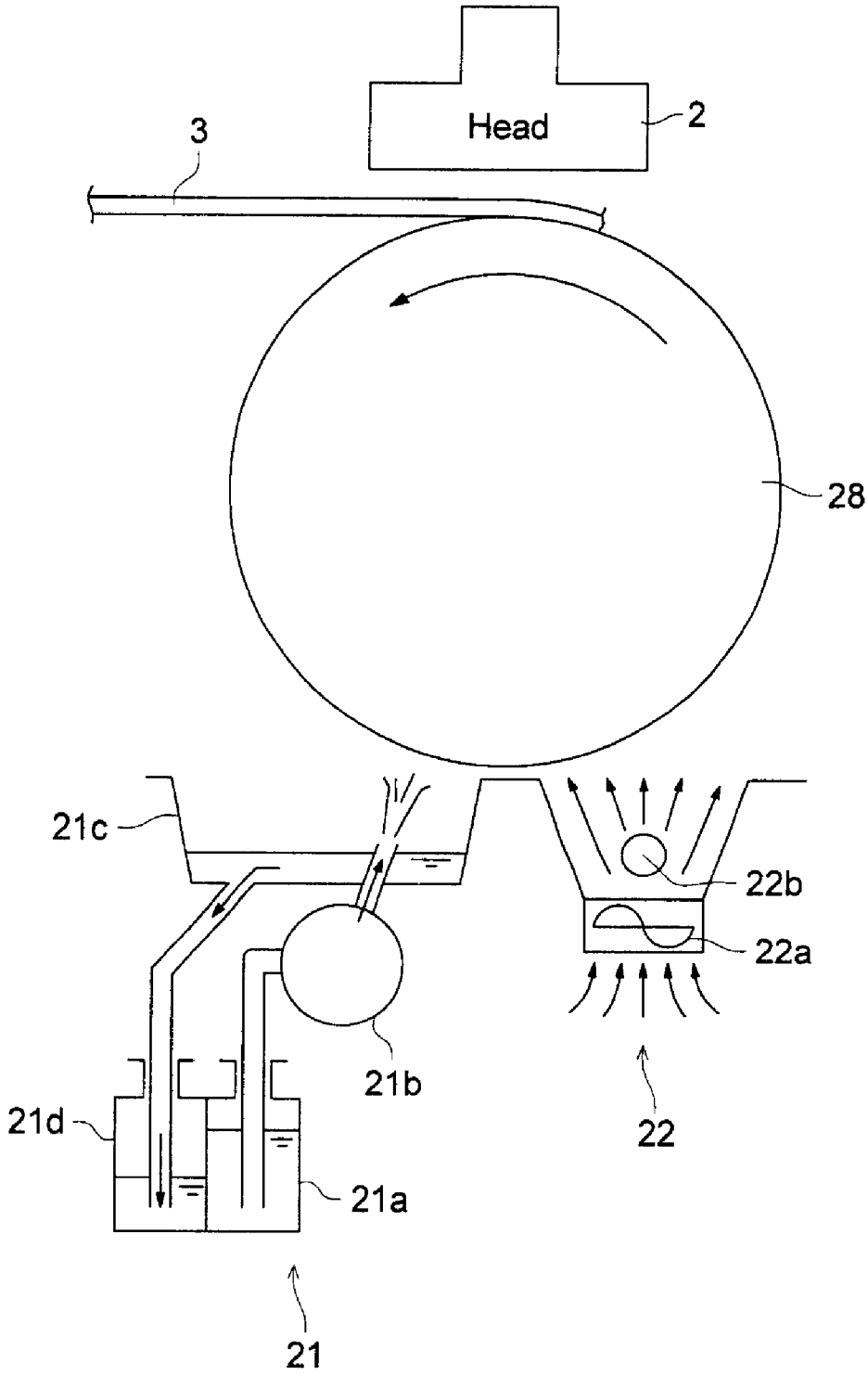
FIG. 23 is a schematic view showing an example of the constitution of a washing unit and a drying unit which are means to prevent the re-adhesion of ink which has been adhered onto the platen roller and hairs (projections) to a fabric.

In addition, from the viewpoint of maintaining the desired high quality of images formed on fabric 3, it is preferable that a means (being a re-adhesion preventing means) be provided which minimizes re-adhesion of ink adhered onto platen roller 28 as well as hairs onto fabric 3. Employed as specific means may be a structure comprised of washing device 21 (being a washing means) which washes platen roller 18 as well as hairs by spraying water or washing liquid, as shown in FIG. 6, and a structure comprised of a washing device along with drying device 22 (being a drying mean) which dries platen roller 28 as well as hairs after washing. Incidentally, in FIG. 23, the washing device 21 is provided with washing liquid tank 21*a*, pump 21*b*, washing effluent receiving tray 21*c*, and effluent storage tank 21*d*, while drying device 22 is provided with air blowing fan 22*a* and heater 22*b*.

Figure 24:
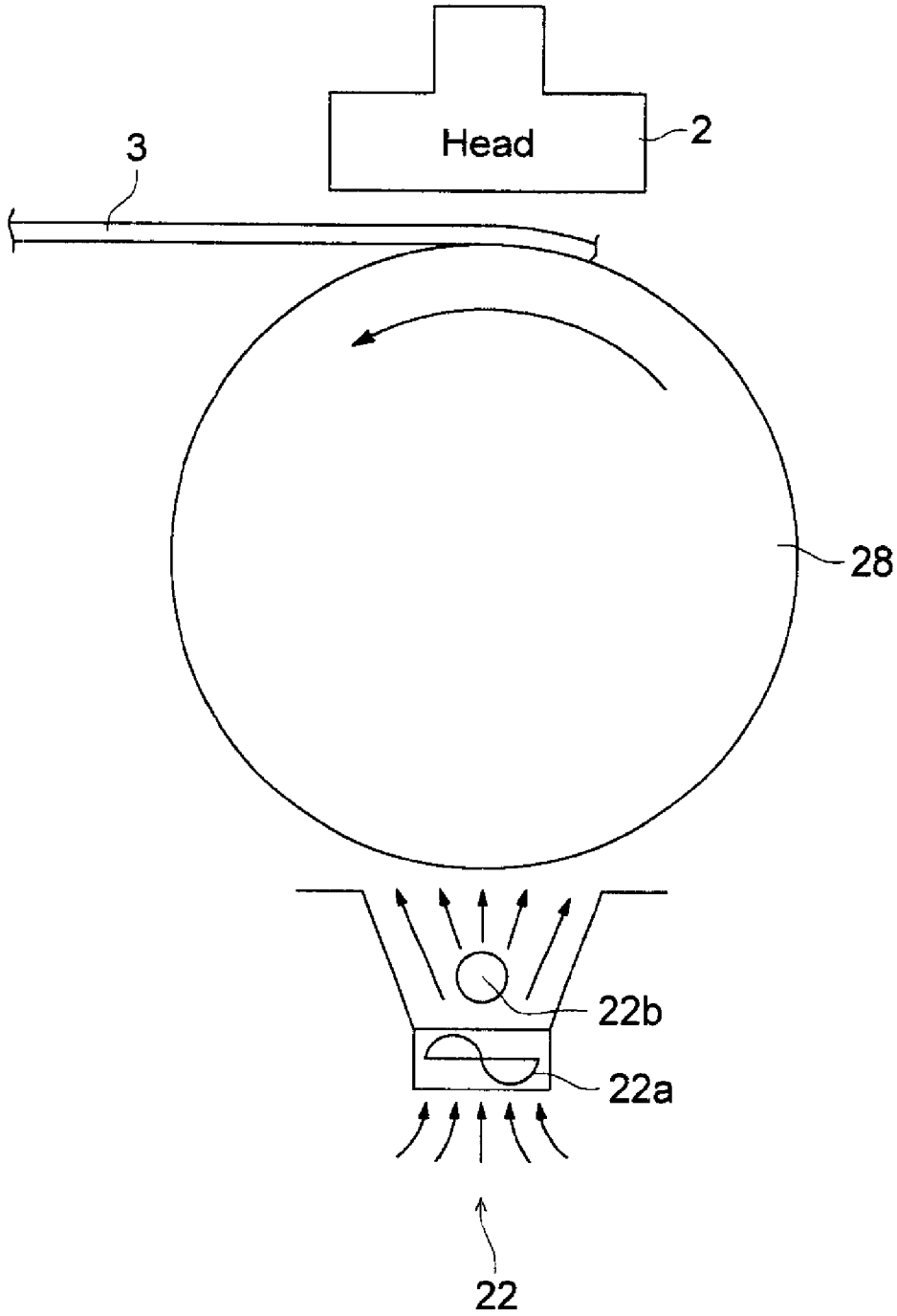
FIG. 24 is a schematic view showing an example of the constitution of a drying unit which is a means to prevent re-adhesion of ink which has been adhered onto a platen roller as well as hairs (projections) to a fabric.

Further, in still another example, as shown in FIG. 24, it is possible to employ a structure in which only drying device 22 is provided which dries ink adhered onto platen roller 28 as well as hairs without contact. In such a case, ink is not removed from the surface of the platen roller 28. However, since the ink is hardened by drying, it is possible to retard the re-adhesion of ink onto fabric 3. Preferably employed as heater 22*b* of drying device 22 may be one generating far-infrared rays which exhibit relatively good heating effects. Specific examples, which generate far-infrared rays, include far-infrared heaters as well as halogen heaters. When these heaters are employed, it is possible to adjust the temperature to the desired range at relatively low power. As a result, it is possible to lower operation cost.

Figure 25:
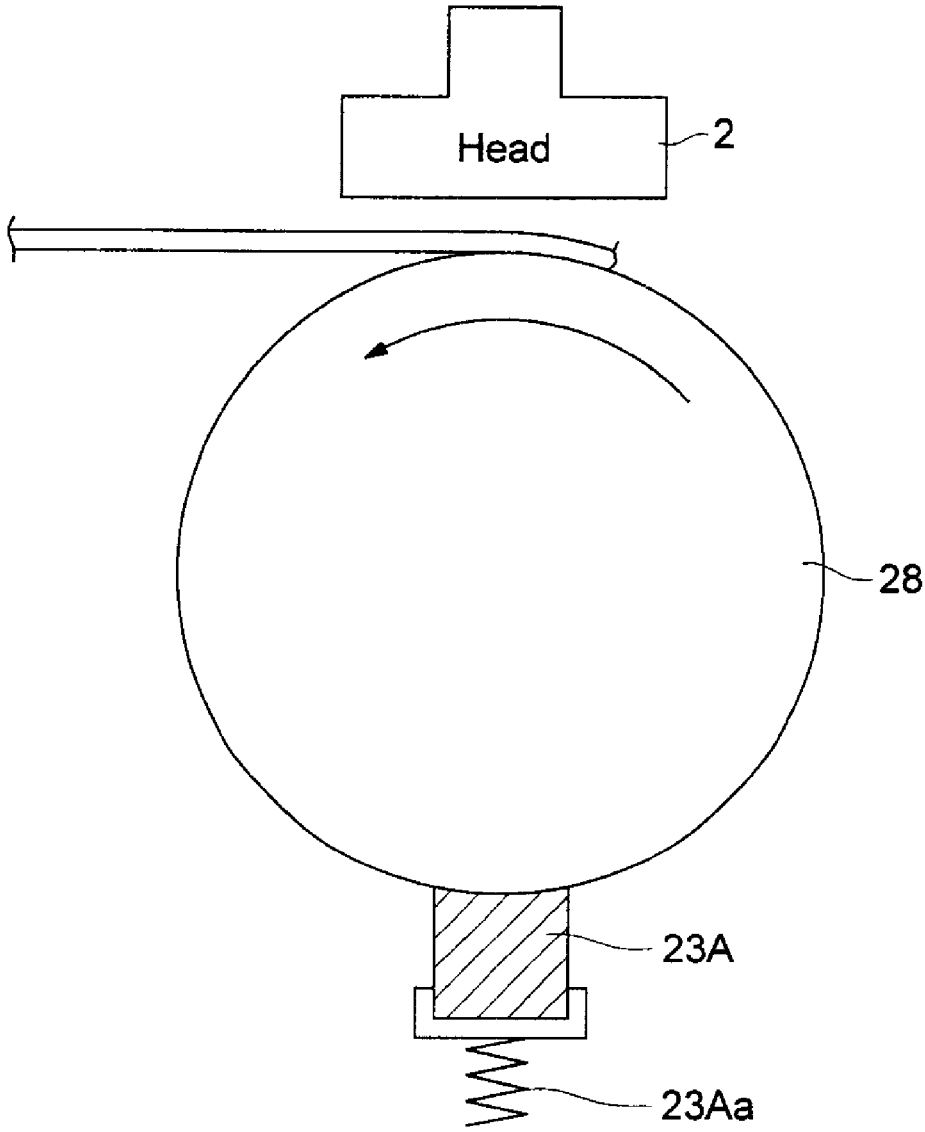
FIG. 25 is a schematic view showing an example of the constitution of an ink absorbing member which is a means to prevent re-adhesion of ink which has been adhered onto a platen roller as well as hairs (projections) to a fabric.

In still another example, as shown in FIG. 25, it is possible to minimize re-adhesion of adhered ink onto fabric 3 by utilizing a structure in which absorbing member 23A, which absorbs ink, is brought into pressure contact with the platen roller employing a pressing means such as spring 23Aa. Such a structure, employing the absorbing member, makes it possible to be less costly.

Figure 26:
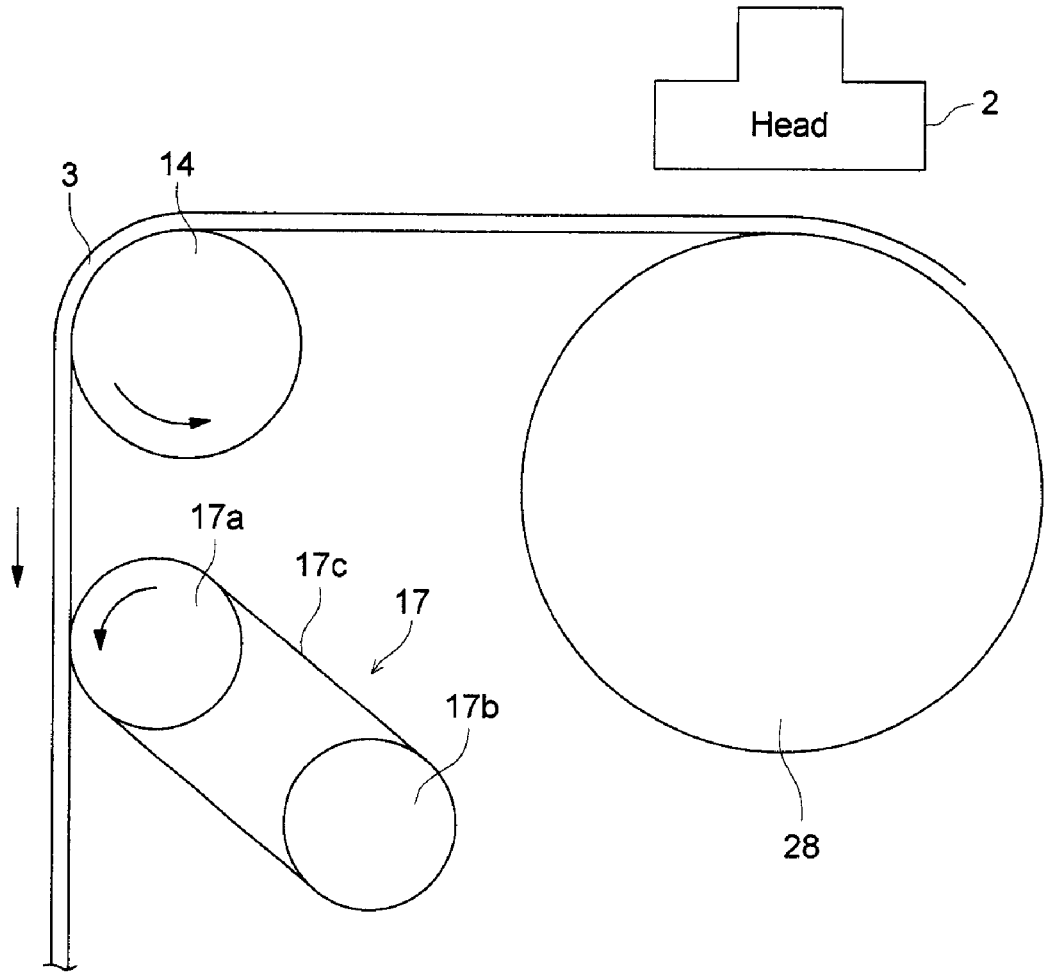
FIG. 26 is a view showing an embodiment in which the double-faced adhesive tape according to the second embodiment of the present invention is used as a removing means.

In addition, it is more preferable that a means (a removal means) is provided which removes projections which have dropped from platen roller 28 and subsequently adhered onto fabric 3, and especially removes hairs when the hairs are employed as projections. Specifically considered as the removal means is the structure shown in FIG. 26. The structure, shown in FIG. 26, is such that the inner surface of fabric 3, downstream of platen roller 28, is brought into contact with double-sided adhesive tape 17*c* entrained about drive roller 17*a* and driven roller 17*b*, whereby hairs adhered on the inner surface of the fabric 3 are removed.

Figure 27:
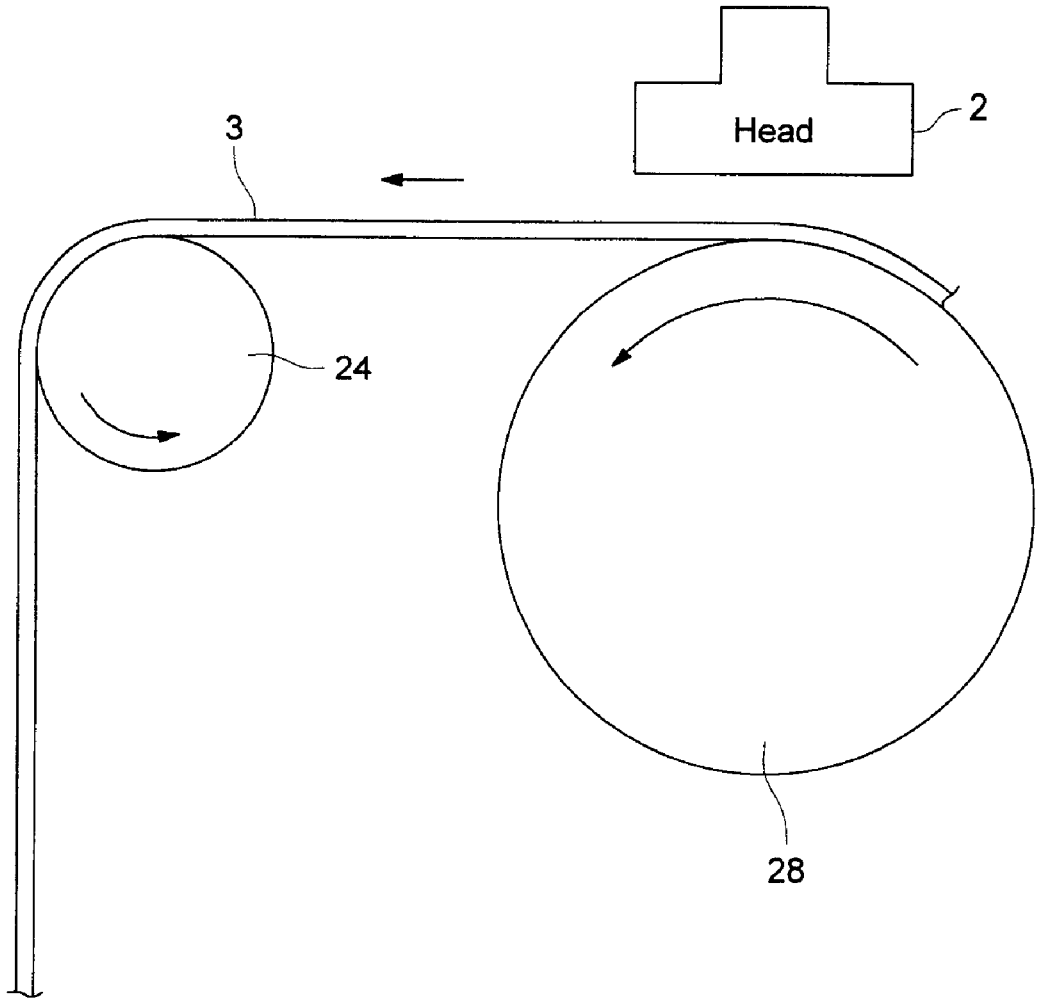
FIG. 27 is a view showing an embodiment in which the cleaning roller according to the second embodiment of the present invention is used as a removing means.

Other examples of the removal means may include structures in which, as shown in FIG. 27, fabric 3 is carried over cleaning roller 24 replaced with feed-out roller 14 and fabric 3 is conveyed by cleaning roller 24. Considered as specific examples of the cleaning roller 24 are a roller of which surface is adhered with a double-sided adhesive tape, a roller to which surface glue or adhesives are applied, and an adhesive rubber roller.

Figure 28:
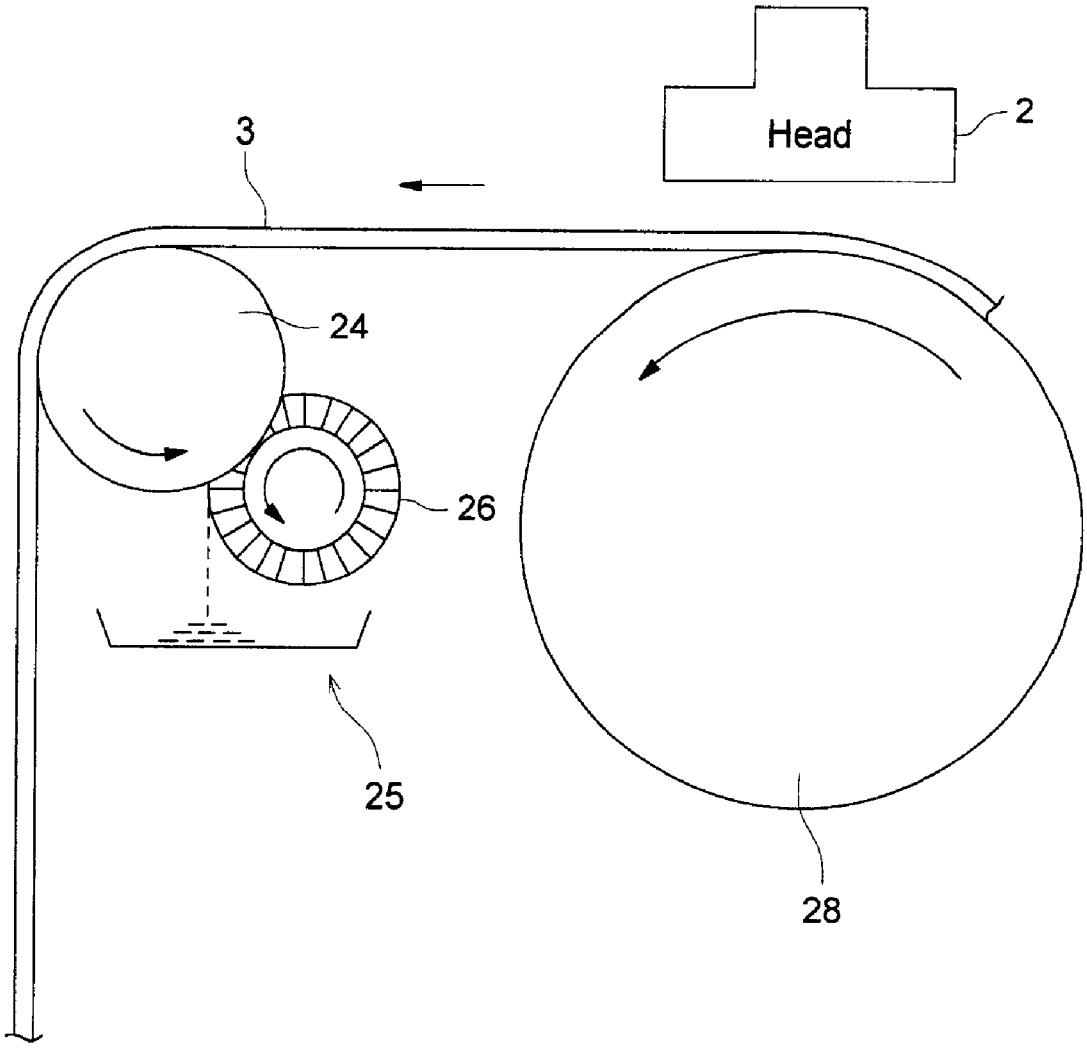
FIG. 28 is a view showing an embodiment in which the cleaning roller according to the second embodiment of the present invention is provided with a brush roller as a retrieving means.
Figure 29:
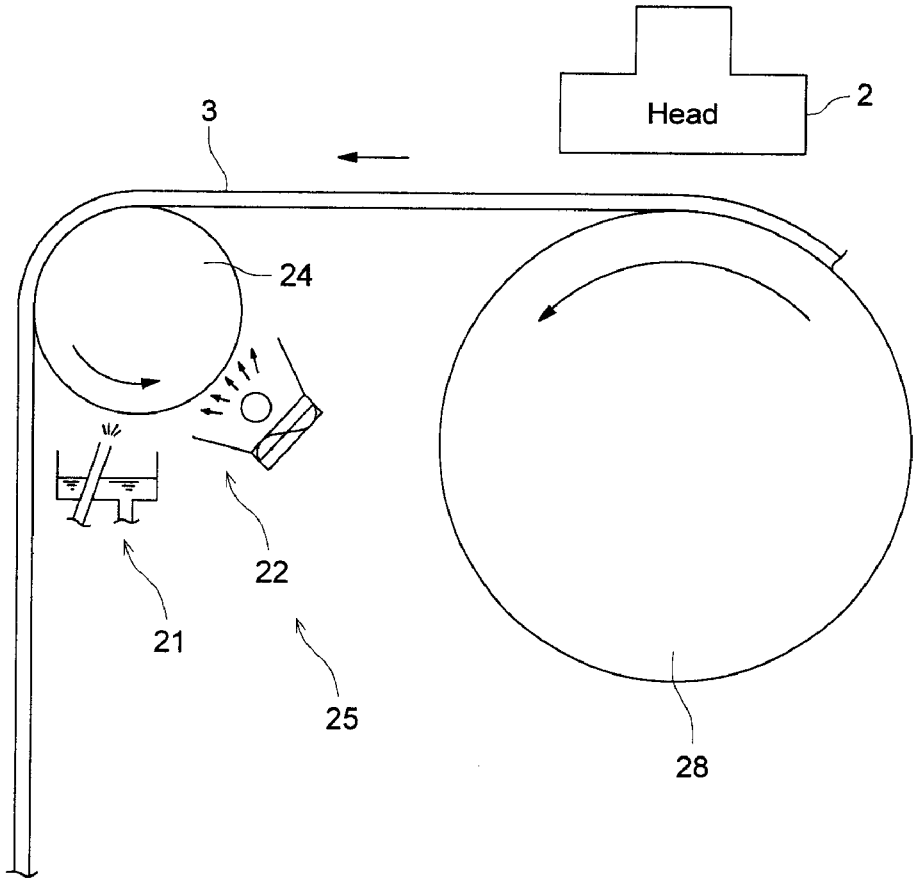
FIG. 29 is a view showing an embodiment in which the cleaning roller according to the second embodiment of the present invention is provided with a washing unit and a drying unit as a retrieving means.
Figure 30:
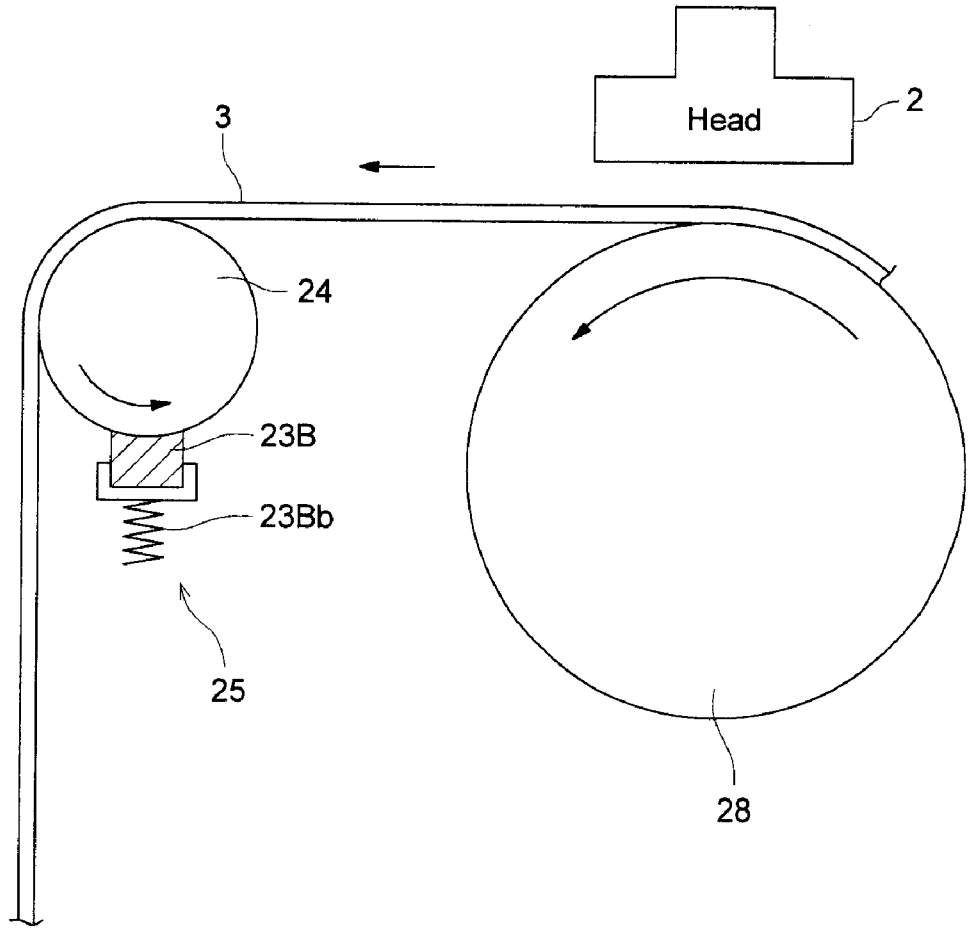
FIG. 30 is a view showing an embodiment in which the cleaning roller according to the second embodiment of the present invention is provided with an absorbing member as a retrieving means.

It is further preferable that hairs, which are removed from the surface of fabric 3 and remain on the removal means, are recovered by recovery means 25. Incidentally, the recovery means 25 is capable of recovering hair removing function of the removal means. Considered as specific examples of the recovery means 25 are one in which, as shown in FIG. 28, cleaning roller 24 is rotated through contact with brush roller 26 so that hairs adhered on the cleaning roller 24 are scraped off, and one which, as shown in FIG. 29, is provided with the washing device 21 (being a washing means) as well as drying device 22 (being a drying means), and one in which, as shown in FIG. 30, absorbing member 23B is brought into pressure contact with cleaning roller 24, employing a pressing means such as spring 23Bb. For example, by employed urethane foam, hairs can be absorbed into cavities of the urethane foam.

Figure 31:
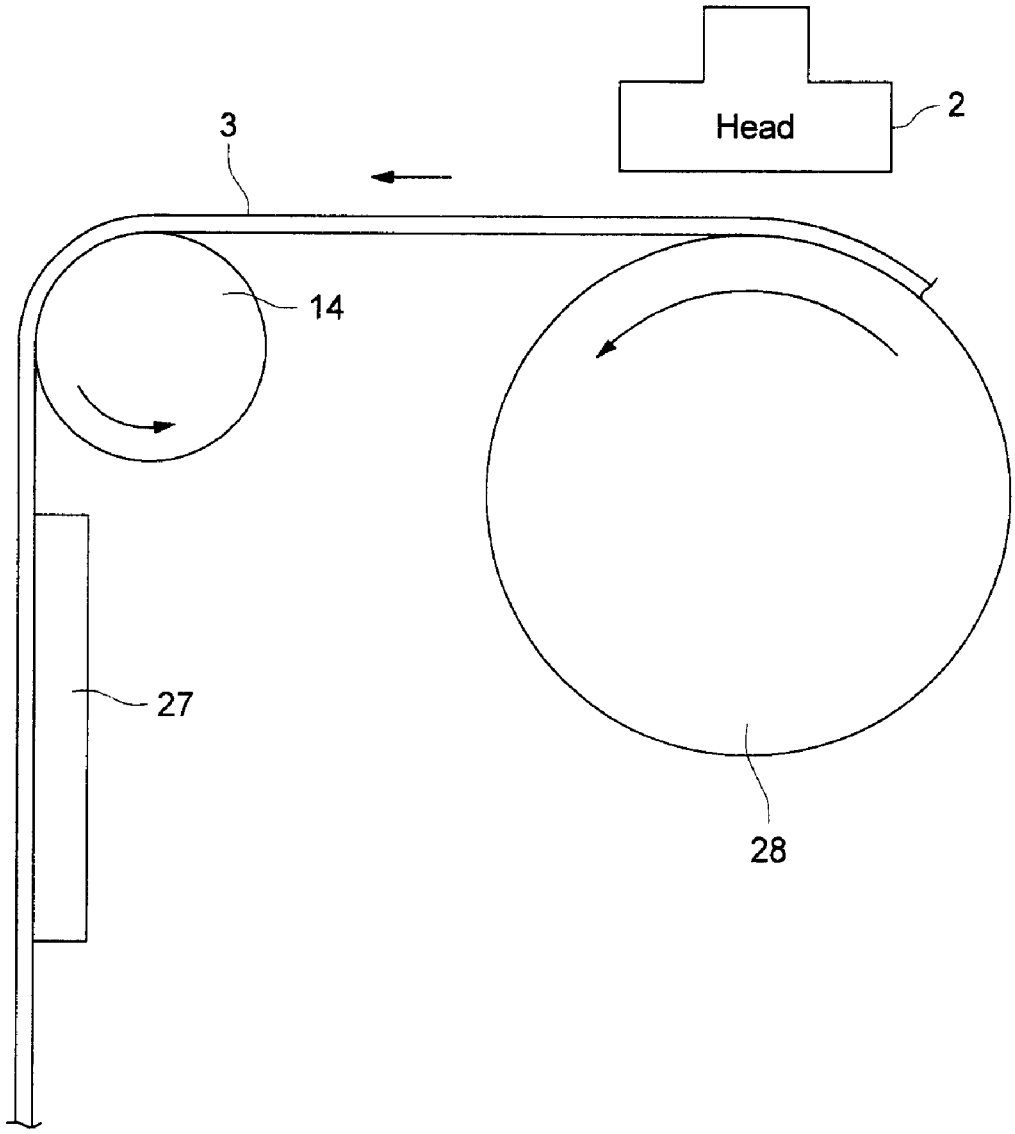
FIG. 31 is a view showing an embodiment in which an electrostatic adhesion plate, according to the second embodiment of the present invention, is used as a removing means.

Further, still another example of the removal means includes a structure in which, as shown in FIG. 31, electrostatic adhesion plate 27 is brought into contact with the inside surface of fabric 3 and when the fabric 3 moves on the surface of the electrostatic adhesion plate 27, hairs adhered on the inner surface of the fabric 3 may be removed utilizing electrostatic adhesion force. Since the electrostatic adhesion plate 27 is not provided with consumable materials, it can be easily reused.

Incidentally, structures and functions as above are described regarding needles or implanted hairs on platen roller 28. However, needless to say, the above description is basically applicable to any projections such as the needles, solid materials, and hairs which are formed on platen roller 28.

Incidentally, in the present invention, effects as above may be obtained employing a platen roller which does not comprise projections as above. Specifically, for example, the portion of the platen roller, which comes into contact with the fabric 3, may be formed employing rubber materials which exhibit relatively high friction against the fabric 3. Herein, listed as rubber materials are EPDM, silicone rubber, and adhesive rubber (in this case, the entire platen roller 28 corresponds to "recording medium expansion and contraction-preventing means", as described in the present invention). Even in such a case, elongation and shrinkage of fabric 3 are minimized because fabric 3, conveyed while brought into semi-contact with the rubber material, having a relatively high friction, is subjected to limitation against free dimensional change. Accordingly, even in this case, images are not partially elongated or shortened, whereby it is possible to carry out desired image formation.

Further, as is initially pointed out in the description of the embodiments of the present invention, the present invention is not limited to fabric 3 as a recording medium. Namely, in principle, it is possible to apply the present invention to paper and various other sheet materials even though "recording medium" include these. In addition, it is assumed that almost the same effects as above are exhibited when these are employed. However, it is to be pointed out that the present invention exhibits the most desired effects when ink jet printing is carried out employing fabric 3.

EFFECT OF THE INVENTION

As described above, the ink-jet printer of the present invention minimizes elongation and shrinkage of a recording medium as well as further deformation of the same, whereby it is possible to carry out desired image formation utilizing the recording medium. Particularly, when a fabric is employed as the recoding medium, the present invention exhibits its maximum effect.

What is claimed is:

1. An ink-jet printer comprising:

a recording head to eject ink through a nozzle;

conveying means located to face the recording head and conveying a recording medium onto which an image is recorded by the recording head; and recording medium expansion and contraction-preventing means provided at a contacting portion where the conveying means contacts the recording medium.

2. An ink-jet printer comprising:

a recording head ejecting ink through a nozzle;

an endless belt located to face the recording head and conveying a recording medium onto which an image is recorded by the recording head; and projections provided on the surface of the endless belt.

3. The ink-jet printer of claim 2, wherein the projections are provided on the entire surface of the endless belt.

4. The ink-jet printer of claim 2, wherein the projections are provided along the both edges of the surface of the endless belt in the perpendicular direction to the moving direction of the endless belt.

5. The ink-jet printer of claim 4, wherein the recording head is arranged so as to be movable in the crossed direction to the conveying direction of the recording medium conveyed by the conveying means and the projections are located so as to keep in noncontact with at least the nozzle when the recording head moves on a position facing the projections.

6. The ink-jet printer of claim 5, wherein the projections are provided on the endless belt so as to enable to rise and fall.

7. The ink-jet printer of claim 6, wherein the recording head comprises a guard member to bring down the projections so that the projections keep in noncontact with the nozzle when the recording head moves on the position facing the projections.

8. The ink-jet printer of claim 7, wherein the guard member is located at a forward and backward positions of the nozzle with respect to a moving direction of the recording head and is located so as to be projected toward the endless belt with respect to the nozzle.

9. The ink-jet printer of claim 4, wherein the both edges are out of a region in which the image is recorded by the recording head; and the recording head is movable in the crossed direction to the conveying direction of the recording medium conveyed by the conveying means, and when the recording head moves on a position facing the projections, the recording head can be displaced so that the nozzle keep in noncontact with the projections.

10. The ink-jet printer of claim 2, wherein the projections are needle-shaped members.

11. The ink-jet printer of claim 10, wherein the needle-shaped members has bent form toward the downstream side in the conveying direction of the recording medium, or inclined form toward the downstream side in the conveying direction of the recording medium.

12. The ink-jet printer of claim 2, wherein the projections comprise a solid material.

13. The ink-jet printer of claim 12, wherein the solid material is metallic particles, ceramic particles, or hard plastic particles.

14. The ink-jet printer of claim 13, wherein a medium into which the solid material is kneaded is coated onto the endless belt.

15. The ink-jet printer of claim 13, wherein a medium into which the solid material is kneaded is adhibited onto the endless belt.

16. The ink-jet printer of claim 13, wherein the solid material is shaped so as to have a corner.

17. The ink-jet printer of claim 2, wherein the projections comprise hairs comprised of fibers.

18. The ink-jet printer of claim 17, wherein the hairs are implanted on the surface of the endless belt.

19. The ink-jet printer of claim 18, wherein the recording medium is a fabric, and the number of the implanted hairs per unit area is more than the number of fine lines of the fabric per the unit area.

20. The ink-jet printer of claim 18, wherein the hairs are implanted so as to be erect.

21. The ink-jet printer of claim 18, wherein the endless belt is arranged so as to have a curvature radius of not less than 20 mm.

22. The ink-jet printer of claim 2, wherein the ink-jet printer comprises a re-adhesion preventing means to prevent re-adhesion of ink, which adheres onto the endless belt or the projections, onto the recording medium.

23. The ink-jet printer of claim 22, wherein the re-adhesion preventing means comprises a washing means to spray a washing liquid onto the endless belt.

24. The ink-jet printer of claim 23, wherein the ink-jet printer comprises a washing liquid drying means to dry the endless belt after washing employing the washing means.

25. The ink-jet printer of claim 24, wherein far-infrared rays are employed as the washing liquid drying means.

26. The ink-jet printer of claim 25, wherein the far-infrared rays are generated by a far-infrared heater or a halogen heater.

27. The ink-jet printer of claim 22, wherein the re-adhesion preventing means comprises an ink drying means to dry ink adhering onto the endless belt or the projections.

28. The ink-jet printer of claim 27, wherein far-infrared rays are employed as the ink drying means.

29. The ink-jet printer of claim 28, wherein the far-infrared rays are generated by a far-infrared heater or a halogen heater.

30. The ink-jet printer of claim 22, wherein the re-adhesion preventing means comprises an ink absorbing means to absorb ink adhering onto the endless belt or the projections by contacting the endless belt.

31. The ink-jet printer of claim 2, wherein the ink-jet printer comprises a removing means to remove a projection, which drop from the endless belt and adhere onto the recording medium.

32. The ink-jet printer of claim 31, wherein the removing means comprises an electrostatic adhesion means to adhere a projection adhering to the recording medium by electrostatic adhesion force.

33. The ink-jet printer of claim 31, wherein the removing means has a cleaning roller rotatably supported and located so that the surface of the cleaning roller on which glue or a gluing material is provided is brought into contact with the recording medium.

34. The ink-jet printer of claim 31, wherein the removing means has a cleaning roller rotatably supported and located so that the surface of the cleaning roller on which a double-faced tape is adhibited is brought into contact with the recording medium.

35. The ink-jet printer of claim 31, wherein the removing means has a cleaning roller rotatably supported and located so that the surface of the cleaning roller on which an adhesive rubber is provided is brought into contact with the recording medium.

36. The ink-jet printer of claim 33, wherein the ink-jet printer comprises a retrieving means to retrieve the projections removed by the cleaning roller.

37. The ink-jet printer of claim 2, wherein the endless belt is located at from a position facing the recording head to downstream with respect to the recording head of the conveying direction of the recording medium.

38. An ink-jet printer comprising:

a recording head to eject ink;

a platen roller located to face the recording head and conveying a recording medium onto which an image is recorded by the recording head; and projections provided on the surface of the platen roller.

39. The ink-jet printer of claim 38, wherein the projections are provided along the both edges of the platen roller in the perpendicular direction to the rotational direction of the platen roller.

40. The ink-jet printer of claim 39, wherein the recording head is movable in the crossed direction to the conveying direction of the recording medium conveyed by the conveying means; and the projections are located so as to keep noncontact with at least the nozzle when the recording head moves on the position facing the projections.

41. The ink-jet printer of claim 40, wherein the projections are provided on the platen roller so as to enable to rise and fall.

42. The ink-jet printer of claim 41, wherein the recording head comprises a guard member to bring down the projections so that the projection keep in noncontact with at least the nozzle when the recording head moves on the position facing the projections.

43. The ink-jet printer of claim 42, wherein the guard member is located at a foreword and backward position of the nozzle with respect to a moving direction of the recording head and is located so as to be projected toward the platen roller with respect to the nozzle.

44. The ink-jet printer of claim 39, wherein the both edges are out of a region in which the image is recorded by the recording head; and the recording head is movable in the crossed direction to the conveying direction of the recording medium conveyed by the platen roller and when the recording head moves on a position facing the projections, the recording head can be displaced so that the nozzle keep in noncontact with the projections.

45. The ink-jet printer of claim 38, wherein the projections are needle-shaped members.

46. The ink-jet printer of claim 45, wherein the needle-shaped members has bent form toward the downstream side in the conveying direction of the recording medium, or inclined form toward the downstream side in the conveying direction of the recording medium.

47. The ink-jet printer of claim 38, wherein the projections comprise a solid material.

48. The ink-jet printer of claim 47, wherein the solid material is metallic particles, ceramic particles, or hard plastic particles.

49. The ink-jet printer of claim 48, wherein a medium into which the solid material is kneaded is coated onto the platen roller.

50. The ink-jet printer of claim 48, wherein a medium into which the solid material is kneaded is adhibited onto the platen roller.

51. The ink-jet printer of claim 48, wherein the solid material is shaped so as to have a corner.

52. The ink-jet printer of claim 38, wherein the projections comprise hairs comprised of fibers.

53. The ink-jet printer of claim 52, wherein the hairs are implanted on the surface of the platen roller.

54. The ink-jet printer of claim 53, wherein the recording medium is a fabric, and the number of the implanted hairs per unit area is more than the number of fine lines of the fabric per the unit area.

55. The ink-jet printer of claim 53, wherein the hairs are implanted so as to be erect.

56. The ink-jet printer of claim 38, wherein the ink-jet printer comprises a re-adhesion preventing means to prevent re-adhesion of ink adheres onto the platen roller or the projections, onto the recording medium.

57. The ink-jet printer of claim 56, wherein the re-adhesion preventing means comprises a washing means to spray a washing liquid onto the platen roller.

58. The ink-jet printer of claim 57, wherein the ink-jet printer comprises a washing liquid drying means to dry the platen roller after washing employing the washing means.

59. The ink-jet printer of claim 58, wherein far-infrared rays are employed as the washing liquid drying means.

60. The ink-jet printer of claim 59, wherein the far-infrared rays are generated by a far-infrared heater or a halogen heater.

61. The ink-jet printer of claim 56, wherein the re-adhesion preventing means comprises an ink drying means to dry ink adhering onto the platen roller or the projections.

62. The ink-jet printer of claim 61, wherein far-infrared rays are employed as the ink drying means.

63. The ink-jet printer of claim 62, wherein the far-infrared rays are generated by a far-infrared heater or a halogen heater.

64. The ink-jet printer of claim 61, wherein the re-adhesion preventing means comprises an ink absorbing means to absorb ink adhering onto the platen roller or the projections by contacting the platen roller.

65. The ink-jet printer of claim 38, wherein the ink-jet printer comprises a removing means to remove a projection, which drop from the endless belt and adhere onto the recording medium.

66. The ink-jet printer of claim 65, wherein the removing means comprises an electrostatic adhesion means to adhere a projection adhering to the recording medium by electrostatic adhesion force.

67. The ink-jet printer of claim 65, wherein the removing means has a cleaning roller rotatably supported and located so that the surface of the cleaning roller on which glue or a gluing material is provided is brought into contact with the recording medium.

68. The ink-jet printer of claim 65, wherein the removing means has a cleaning roller rotatably supported and located so that the surface of the cleaning roller on which a double-faced tape is adhibited is brought into contact with the recording medium.

69. The ink-jet printer of claim 65, wherein the removing means has a cleaning roller rotatably supported and located so that the surface of the cleaning roller on which an adhesive rubber is provided is brought into contact with the recording medium.

70. The ink-jet printer of claim 67, wherein the ink-jet printer comprises a retrieving means which retrieve the projections removed by the cleaning roller.

71. An ink-jet printer comprising:

a recording head to eject ink through a nozzle;

an endless belt located to face the recording head and conveying a recording medium onto which an image is recorded by the recording head; and an adhesive rubber arranged on the surface of the endless belt.

72. An ink-jet printer comprising:

a recording head to eject ink through a nozzle;

a platen roller located to face the recording head and conveying a recording medium onto which an image is recorded by the recording head; and an adhesive rubber provided on the surface of the platen roller.

* * * * *